US012696973B2

(12) United States Patent
DeSpain et al.

(10) Patent No.: US 12,696,973 B2
(45) Date of Patent: Aug. 4, 2026

(54) FOLDING TABLE

(71) Applicant: Firebox Outdoors LLP, Moroni, UT (US)

(72) Inventors: Steven S. DeSpain, Moroni, UT (US); Bryce Justin Twede, Mapleton, UT (US); Tyler Allan, Highland, UT (US); Ben Reneer, Alpine, UT (US)

(73) Assignee: Firebox Outdoors LLP, Moroni, UT (US)

( * ) Notice: Subject to any disclaimer, the term of this patent is extended or adjusted under 35 U.S.C. 154(b) by 67 days.

(21) Appl. No.: 18/468,331

(22) Filed: Sep. 15, 2023

(65) Prior Publication Data

US 2024/0090658 A1 Mar. 21, 2024

Related U.S. Application Data

(60) Provisional application No. 63/375,782, filed on Sep. 15, 2022.

(51) Int. Cl.

| | |
|---|---|
| ***A47B 3/00*** | (2006.01) |
| ***A47B 3/06*** | (2006.01) |
| ***A47B 13/02*** | (2006.01) |
| ***A47B 13/06*** | (2006.01) |

(52) U.S. Cl.

CPC ..... *A47B 3/002* (2013.01); *A47B 3/06* (2013.01); *A47B 2003/008* (2013.01); *A47B 13/021* (2013.01); *A47B 13/06* (2013.01); *A47B 2220/0083* (2013.01)

(58) Field of Classification Search

CPC .. A47B 3/002; A47B 3/08; A47B 3/06; A47B 2003/025; A47B 2003/0824; A47B 13/06

See application file for complete search history.

(56) References Cited

U.S. PATENT DOCUMENTS

| | | | | |
|---|---|---|---|---|
| 2,588,405 | A * | 3/1952 | Munger | A47B 3/12 108/34 |
| 3,271,075 | A * | 9/1966 | Good | A47C 16/02 297/423.41 |
| 5,974,982 | A * | 11/1999 | Lepper | A47B 3/08 108/131 |
| 11,452,368 | B1 * | 9/2022 | Li | A47B 3/08 |
| 2012/0285351 | A1 * | 11/2012 | Cohen | A47B 3/10 108/166 |
| 2017/0013954 | A1 * | 1/2017 | Browne | A47B 3/002 |
| 2022/0118567 | A1 * | 4/2022 | Darling | A47B 1/05 |
| 2022/0386772 | A1 * | 12/2022 | Tabujara | A47B 87/0207 |

* cited by examiner

*Primary Examiner* — Daniel J Rohrhoff

(74) *Attorney, Agent, or Firm* — Brake Hughes Bellermann LLP

(57) ABSTRACT

A device may include a slat defining a planar surface. A device may include a first leg including: a leg segment with a predominantly planar portion. A device may include a spring tab on a first longitudinal end of the leg segment, the first leg being pivotably coupled at the first longitudinal end of the leg segment to the slat. A device may include a second leg pivotably coupled to the slat. A device may include an alignment shaft configured to be coupled to the slat, the spring tab being configured to be coupled to the alignment shaft via a friction fit as the first leg is rotated to an open position.

20 Claims, 24 Drawing Sheets

Detail D

FOLDING TABLE

CROSS REFERENCE TO RELATED APPLICATION

This application is a continuation of, and claims priority to, U.S. Provisional Patent Application No. 63/375,782, filed on Sep. 15, 2022. The disclosure of the foregoing application is incorporated herein by reference in its entirety.

TECHNICAL FIELD

This description relates to folding tables.

BACKGROUND

Folding tables are sometimes desirable because they can be set up when needed and stored when not. While the flexibility of folding tables is highly desirable, some folding tables are not very stable.

SUMMARY

The present disclosure describes a folding table that includes legs that are pivotably coupled to a slat that makes up the table surface. The leg slats include spring tabs that, when rotated into an open position, engage an alignment shaft coupled to the slat. The spring tab may include a rounded tail shaped to contour around the alignment shaft, keeping the leg firmly in an open position via a friction fit. The table may include a first segment and a second segment that may be folded upon one another, creating a small cavity. An additional slat may be stowed within the cavity formed by the folded leg segments. In examples, the spring tab may be configured to apply pressure on the stowed slat.

In some aspects, the techniques described herein relate to a table including: a slat defining a planar surface; a first leg including: a leg segment with a planar portion, and a spring tab on a first longitudinal end of the leg segment, the first leg being pivotably coupled at the first longitudinal end of the leg segment to the slat; a second leg pivotably coupled to the slat; and an alignment shaft configured to be coupled to the slat, the spring tab being configured to be coupled to the alignment shaft via a friction fit as the first leg is rotated to an open position.

In some aspects, the techniques described herein relate to a leg for a table including: a leg segment with a planar portion coupled along a first longitudinal edge to a first side portion and along a second longitudinal edge to a second side portion, the first side portion facing the second side portion; and a spring tab on a first longitudinal end of the leg segment.

In some aspects, the techniques described herein relate to a method of manufacturing a leg for a table including: cutting a perimeter of a leg segment from a sheet of metal, including a spring tab on a first longitudinal end of the leg segment; bending the leg segment adjacent to a first longitudinal edge to produce a first side portion; bending the leg segment adjacent to a second longitudinal edge to produce a second side portion facing the first side portion; and bending the spring tab to include a rounded tail configured to be coupled to an alignment shaft via a friction fit.

DETAILED DESCRIPTION

Tables that can be unfolded and or assembled in the field are very desirable for applications like camping or picnicking. Many folding tables are problematic, however, because they are not secure when assembled, making the table unstable to use. Some folding tables are difficult to transport when disassembled, because either the components do not pack together into a small volume or they do not pack together in a secure manner, allowing the components to rattle and possibly become damaged and scratched in transport. The present application describes a folding table that is sturdy and stable when fully assembled. The folding table also includes features that make it easy to stow members of the table securely against one another in a compact manner when not in use.

The figures in the present application depict an example folding table or components of one thereof. FIGS. 1A to 1J depict the folding table in a fully assembled configuration. FIG. 2A depicts an exploded view of the folding table 200, and FIG. 2B depicts an exploded view of a folding leg of the folding table. FIG. 2C depicts a bottom perspective view of an outer slat with legs folded. FIG. 2D depicts a bottom perspective view of an outer slat with an alignment rod positioned within it. FIGS. 3A to 3J depict the folding table in its disassembled, folded configuration. In examples, the disassembled, folded configuration of the folding table may be used to transport the table or to pack it into a compact space. The folding table described herein may be ideal for camping applications where a user may need to fit the table into a backpack or pack animal saddlebags, but still desire a stable platform for cooking or performing other activities upon.

Figure 1A:
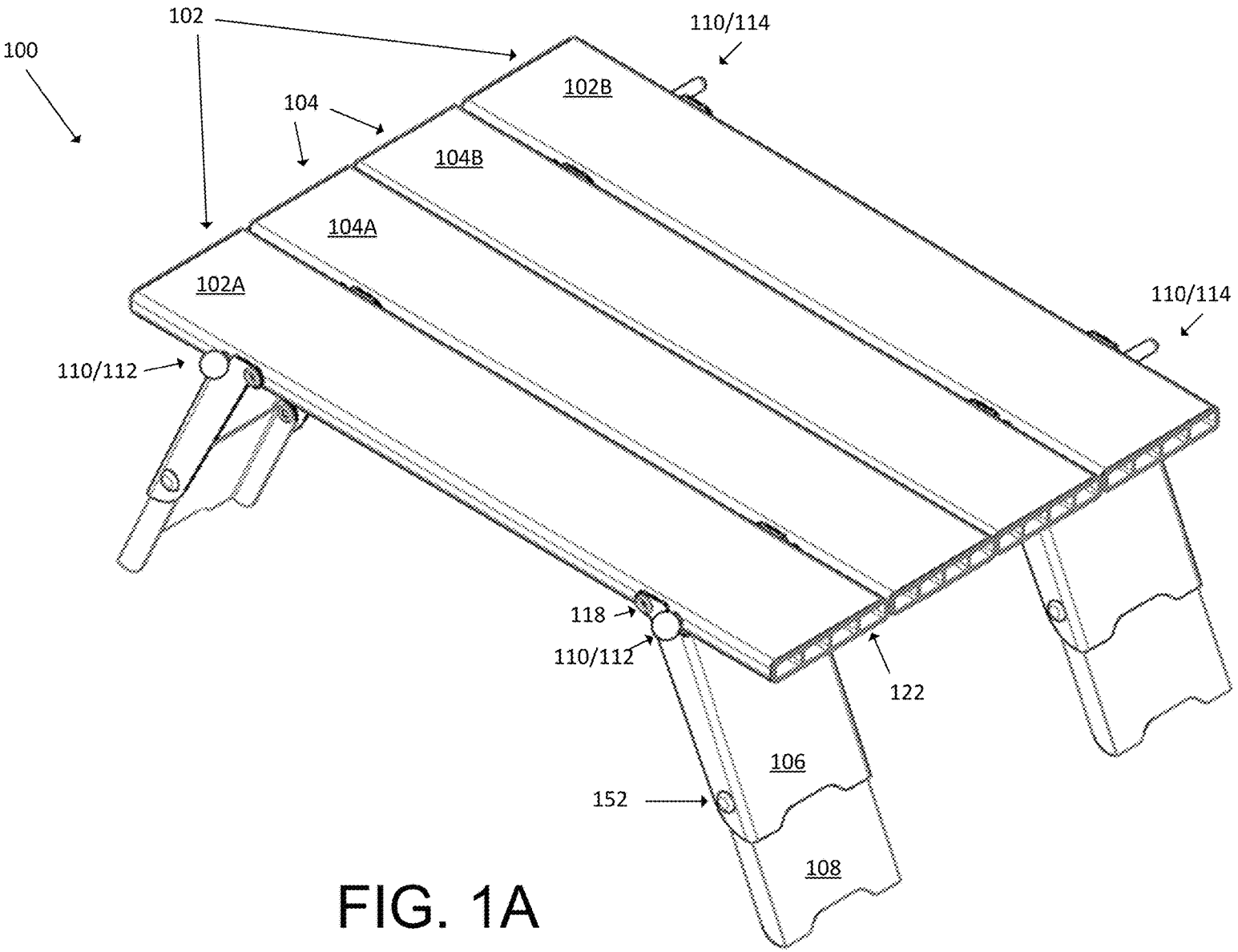
FIG. 1A depicts a perspective view including a top side of a fully assembled folding table, in accordance with an example.
Figure 1B:
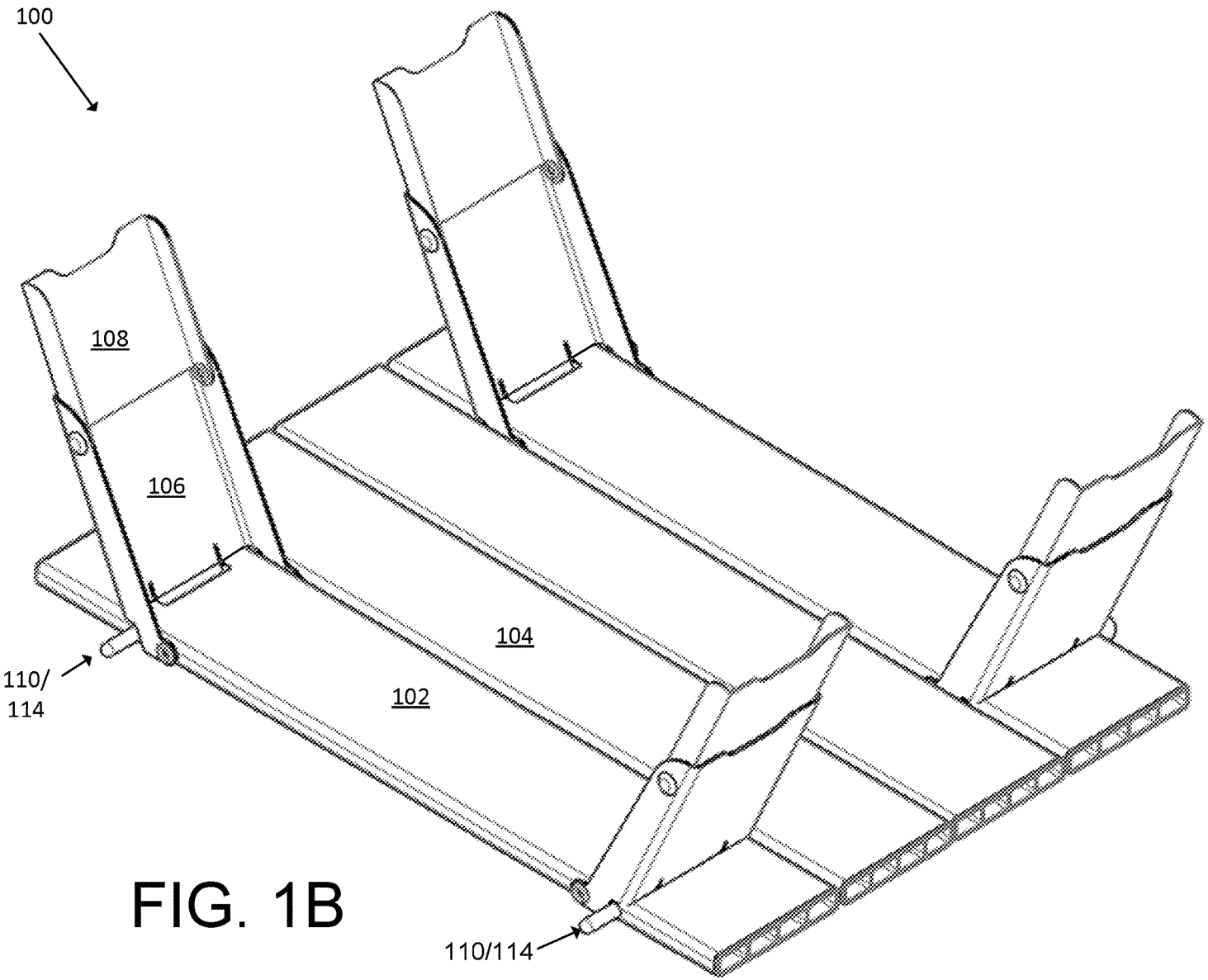
FIG. 1B depicts a perspective view including a bottom side of a fully assembled folding table, in accordance with an example.
Figure 1C:
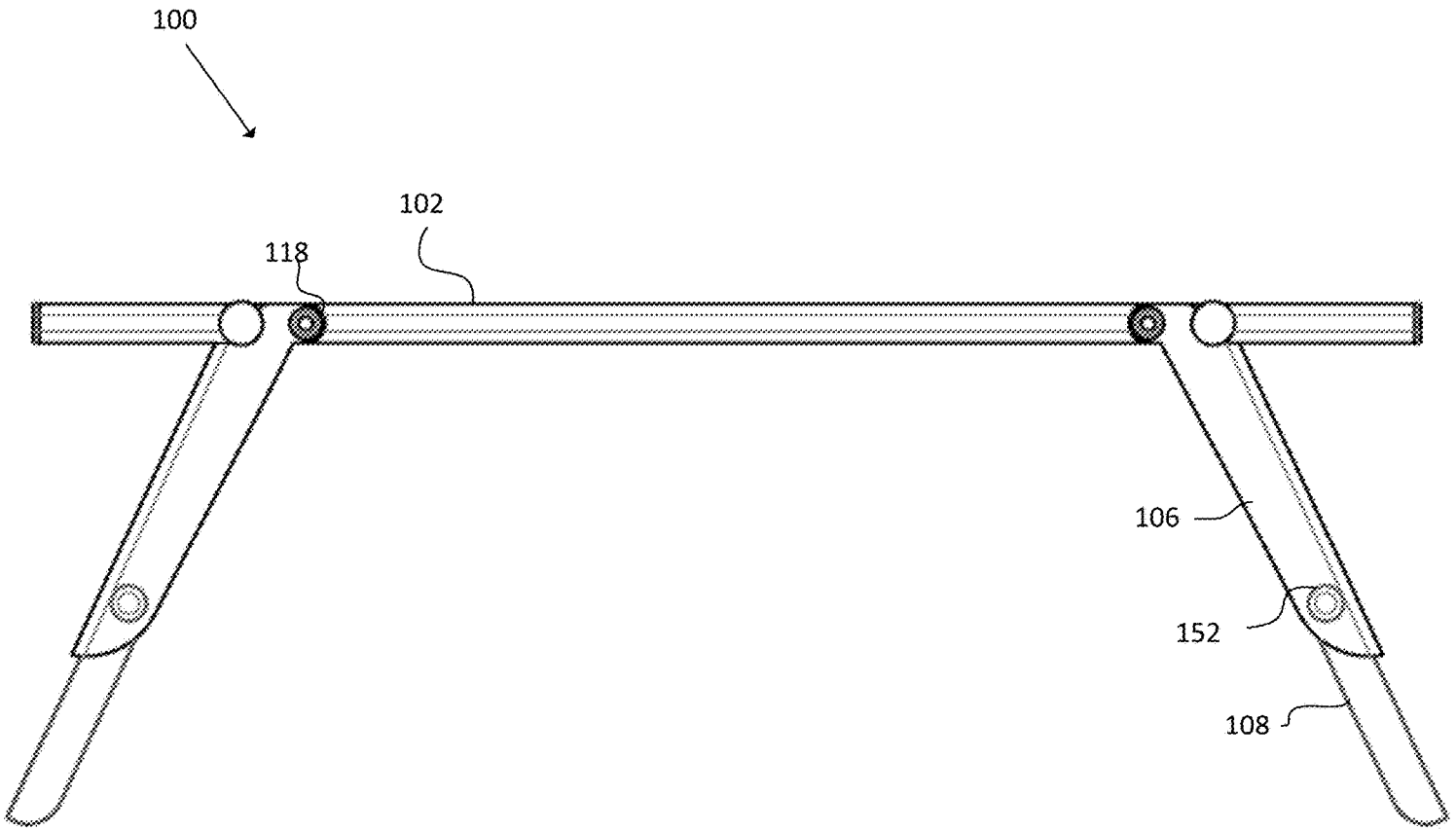
FIG. 1C depicts a front view of a fully assembled folding table, in accordance with an example.
Figure 1D:
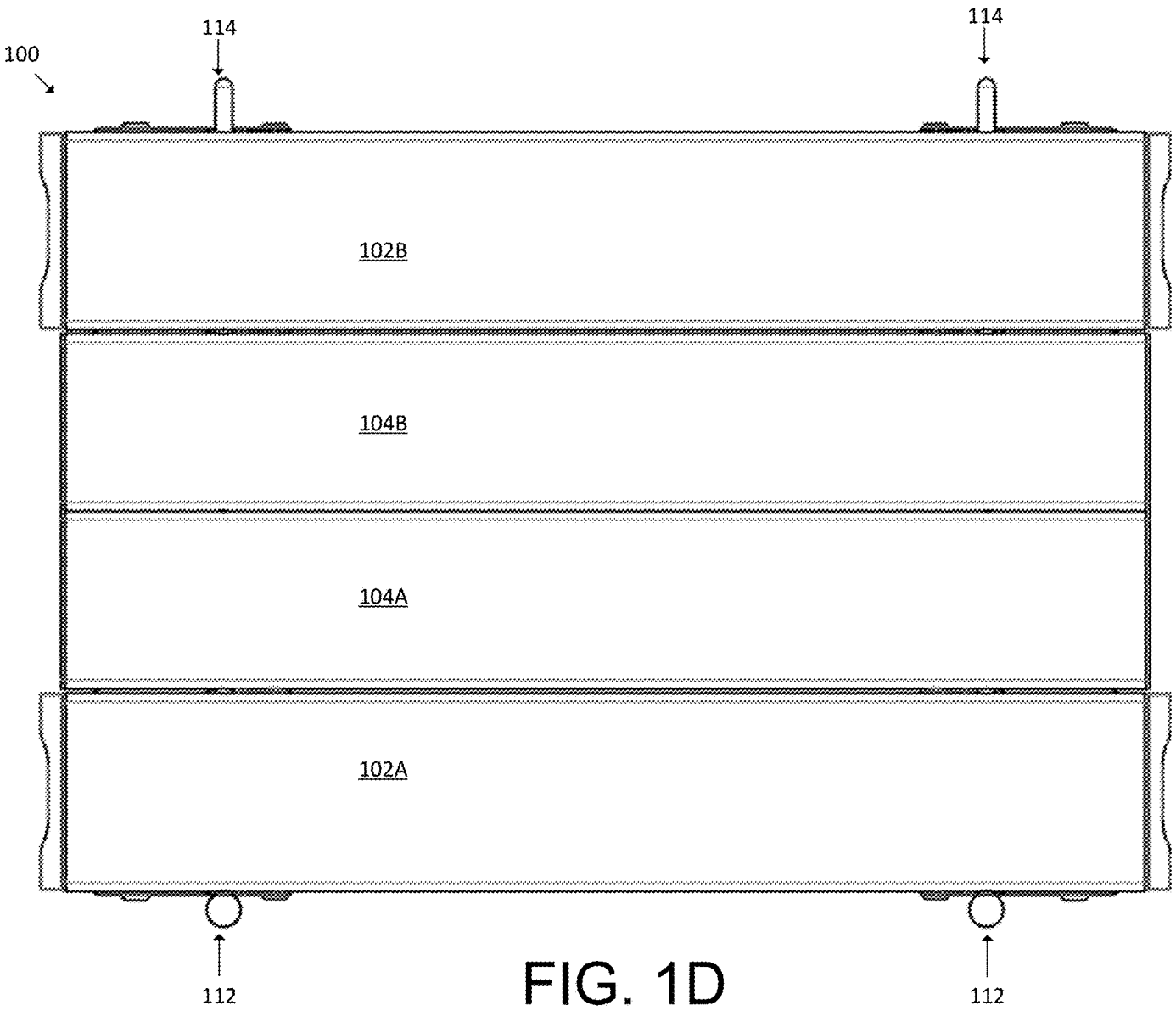
FIG. 1D depicts a top view of a fully assembled folding table, in accordance with an example.
Figure 1E:
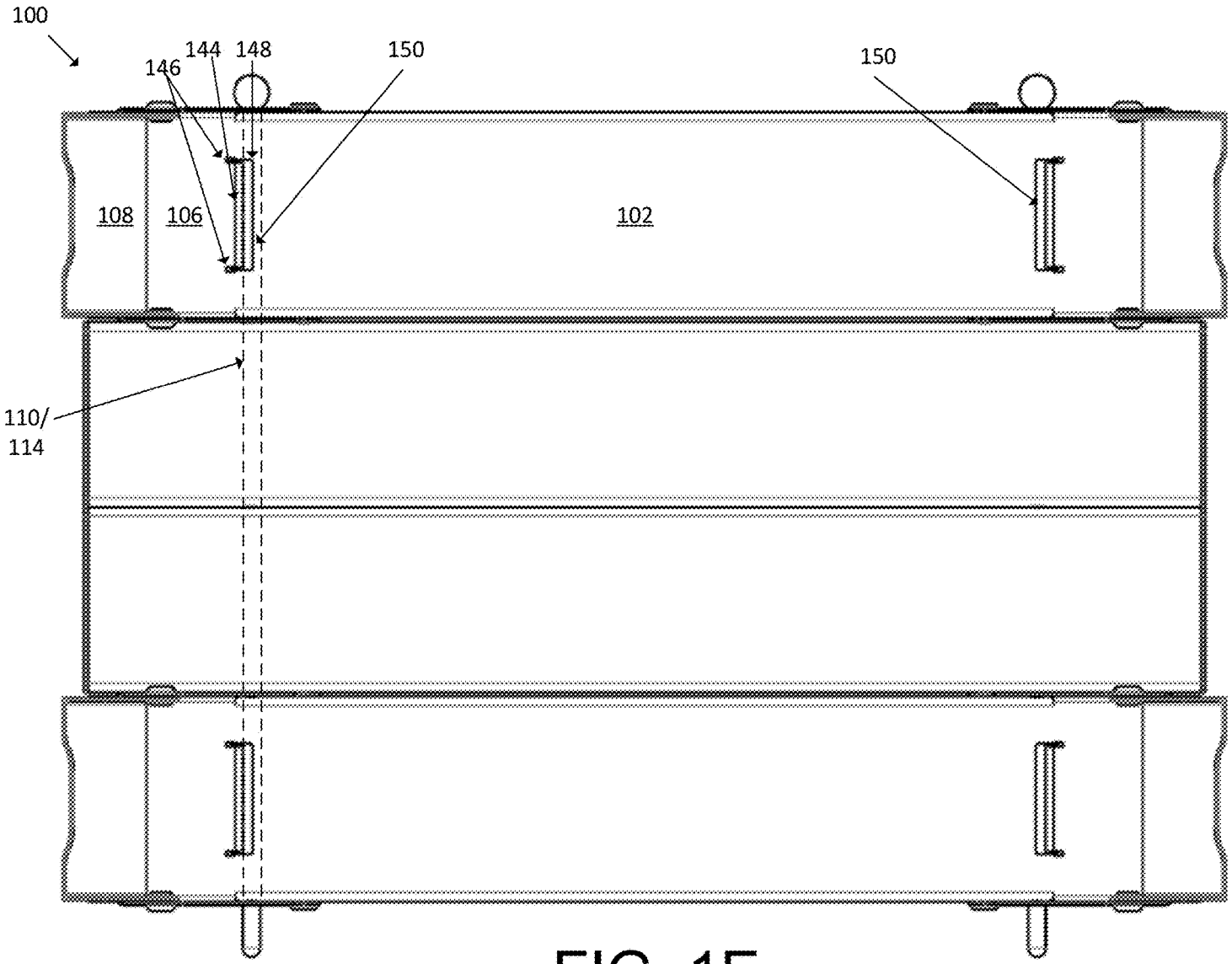
FIG. 1E depicts a bottom view of a fully assembled folding table, in accordance with an example.
Figure 1F:
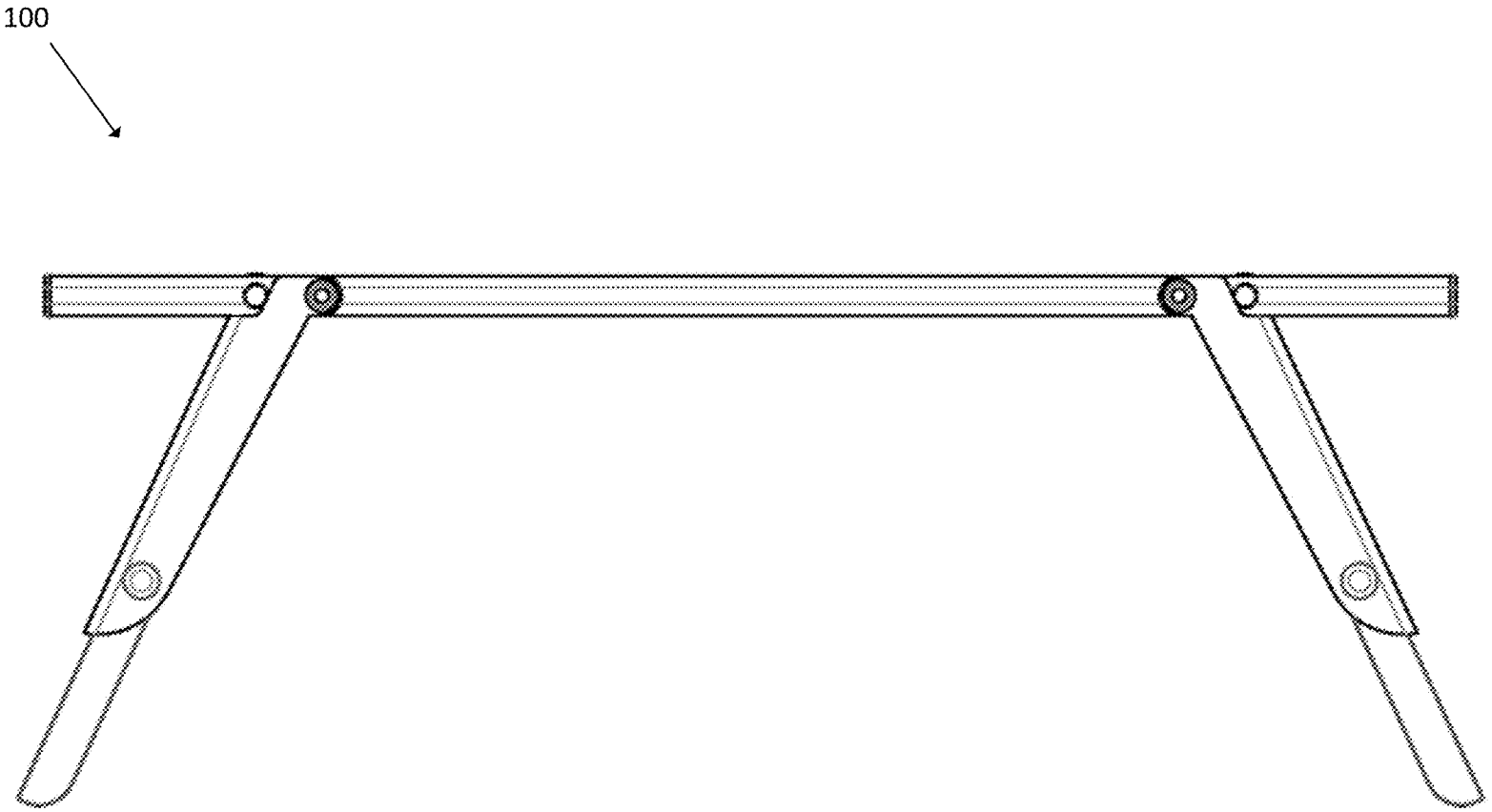
FIG. 1F depicts a back view of a fully assembled folding table, in accordance with an example.
Figure 1G:
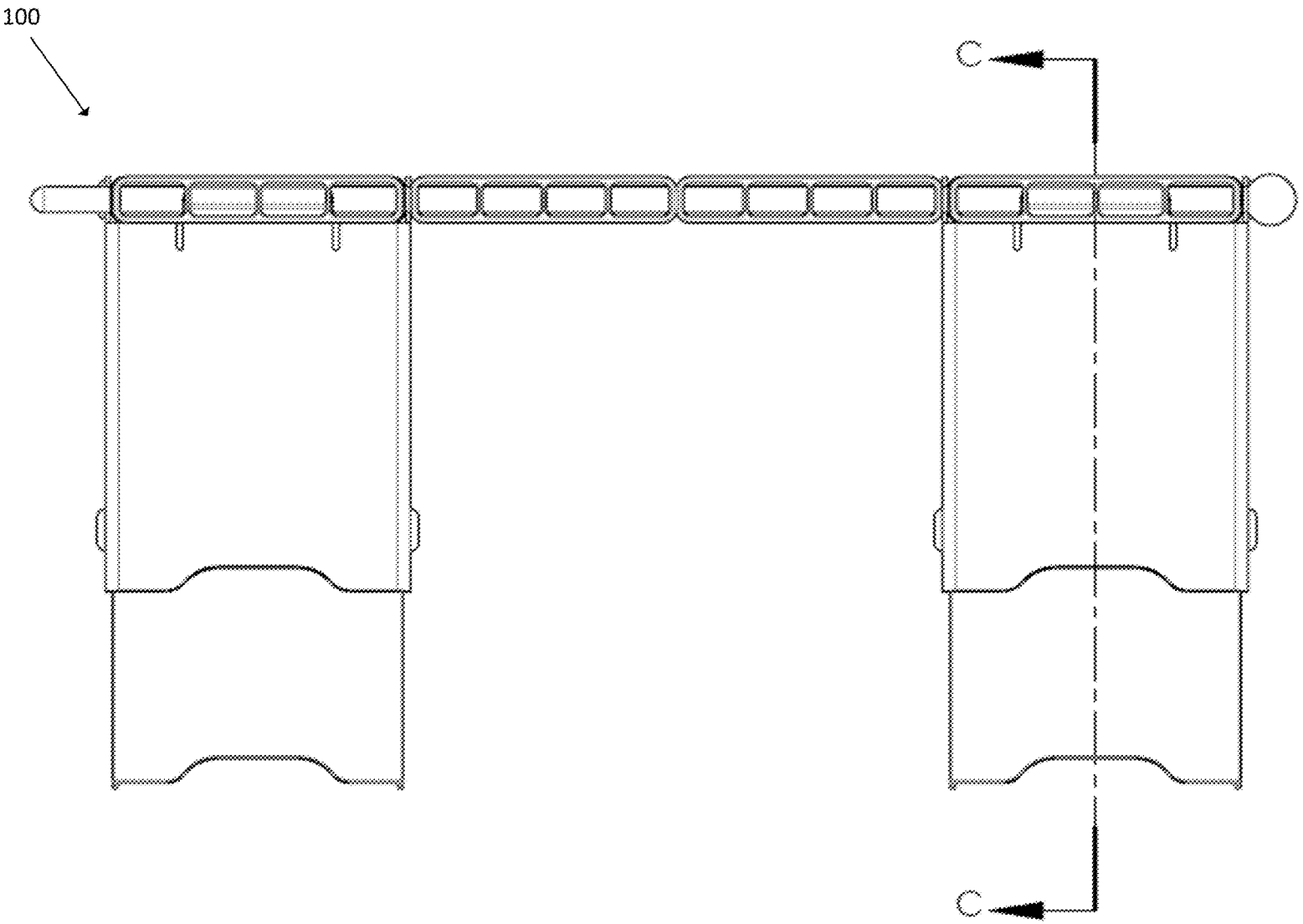
FIG. 1G depicts a left view of a fully assembled folding table, in accordance with an example.
Figure 1H:
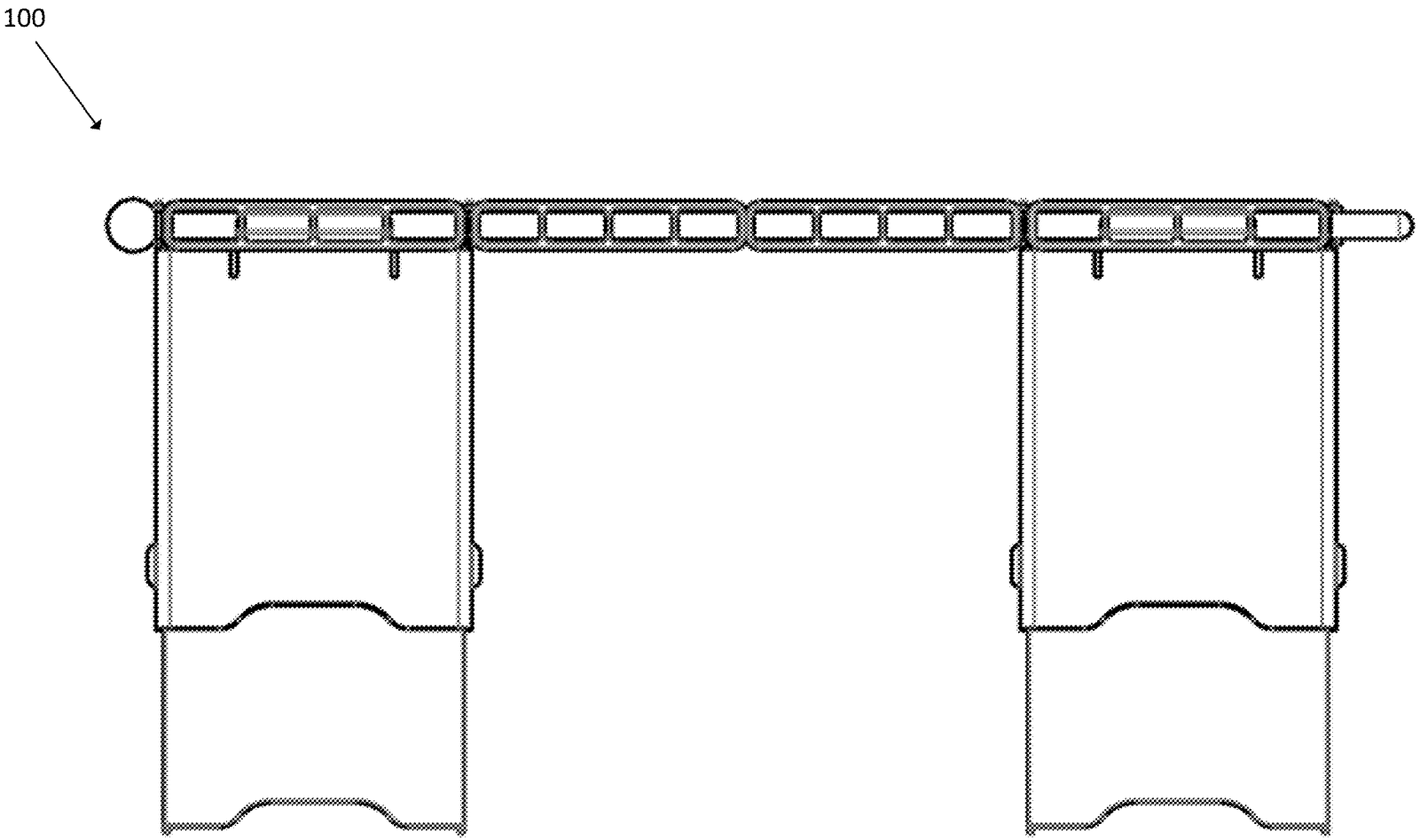
FIG. 1H depicts a right view of a fully assembled folding table, in accordance with an example.
Figure 2A:
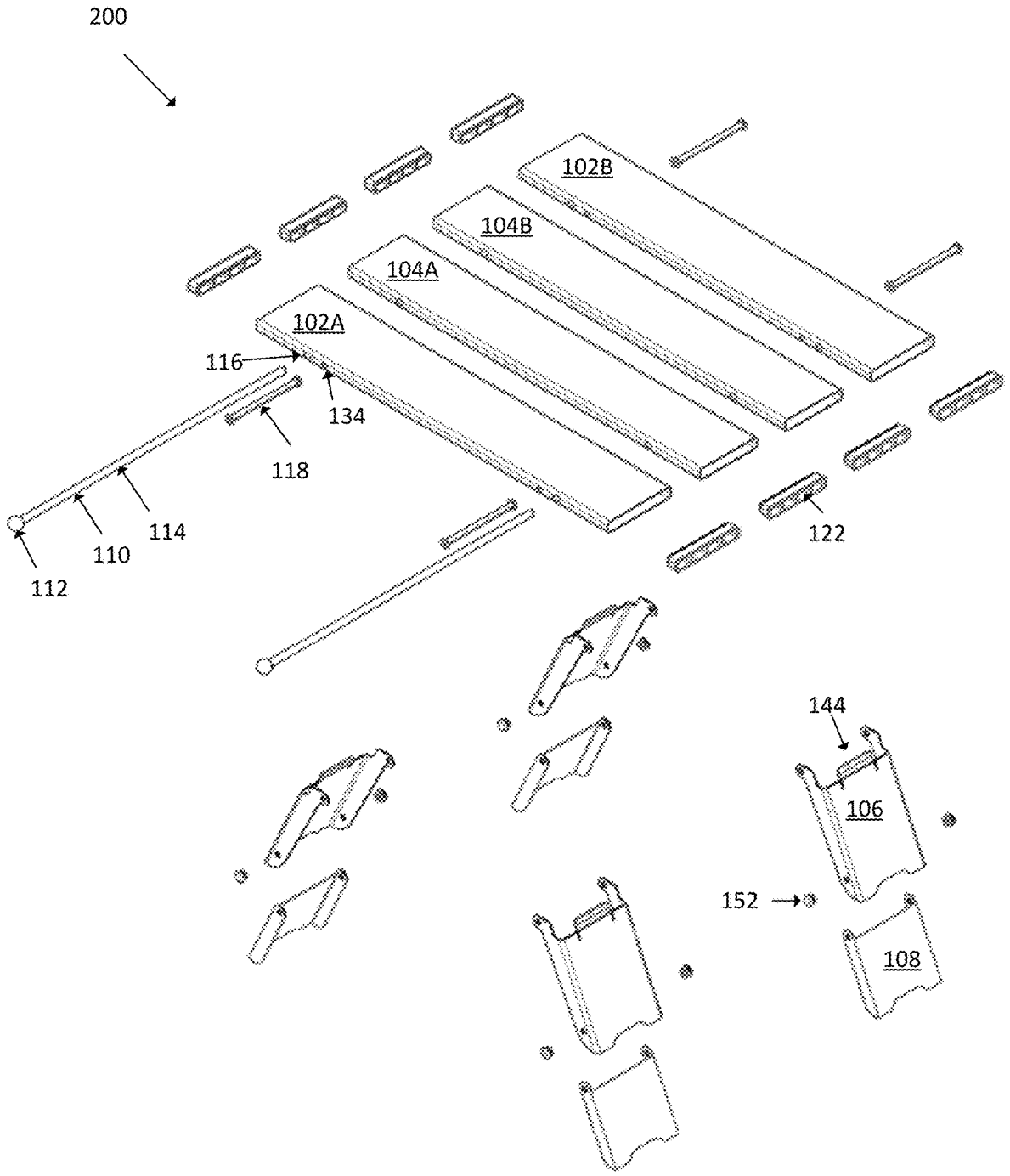
FIG. 2A depicts an exploded perspective view of a fully assembled folding table, in accordance with an example.
Figure 2B:
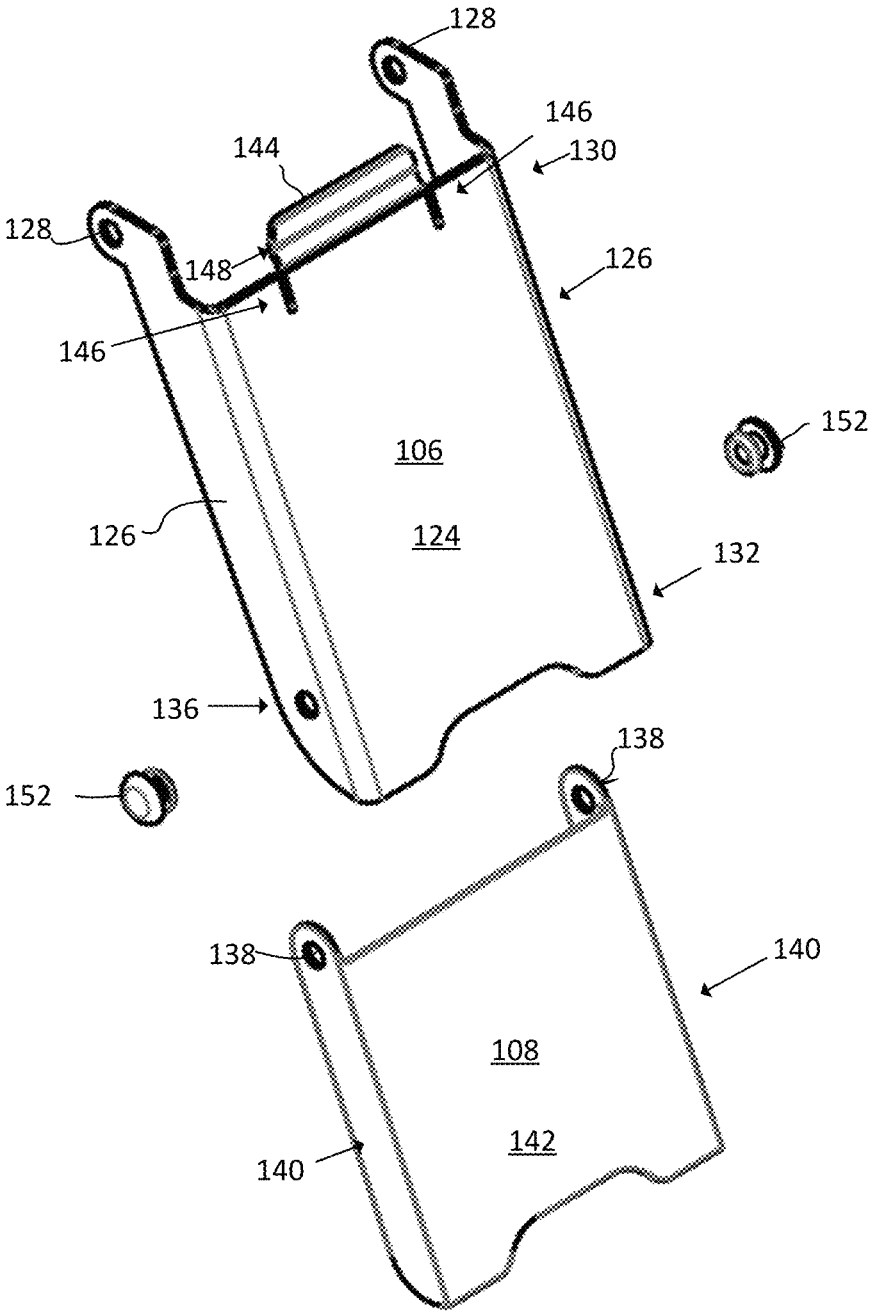
FIG. 2B depicts an exploded perspective view of a folding leg, in accordance with an example.
Figure 2C:
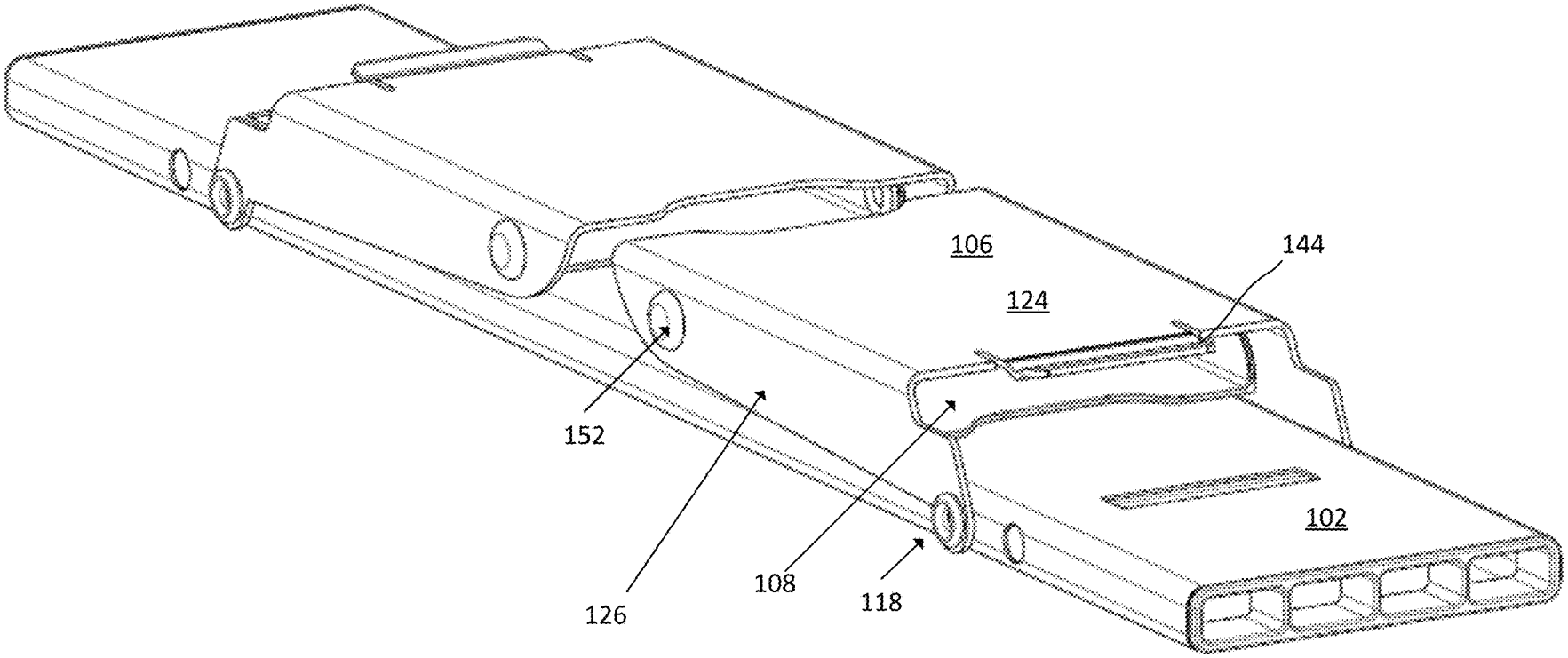
FIG. 2C depicts a perspective view of an outer slat with folding leg in folded position, in accordance with an example.
Figure 2D:
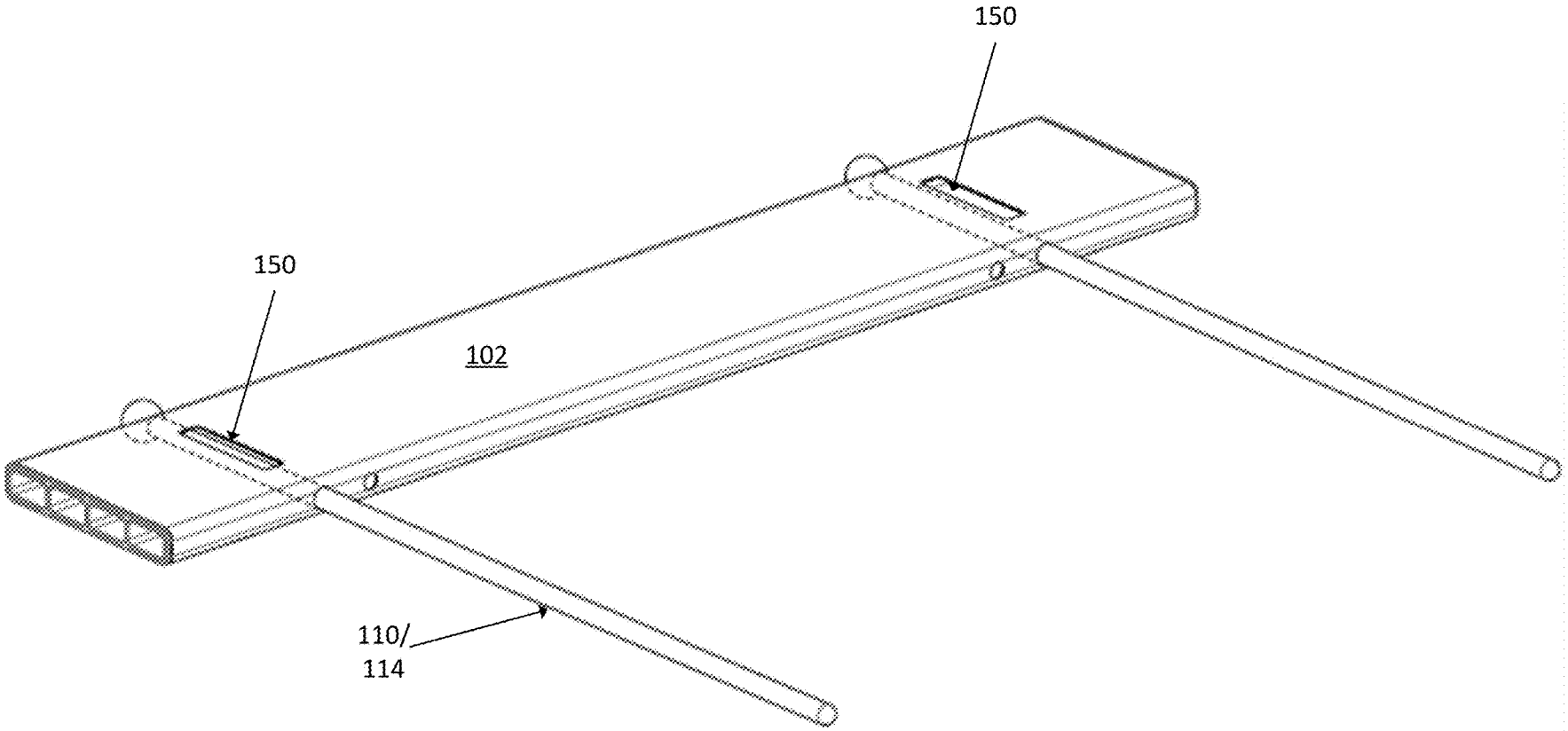
FIG. 2D depicts a bottom perspective view of an outer slat with an alignment rod inserted.

FIG. 1A depicts a perspective view including the top of and FIG. 1B depicts a perspective view including bottom of fully assembled folding table 100, according to an example. FIG. 1C depicts a front view, FIG. 1D depicts a top view, FIG. 1E depicts a bottom view, FIG. 1F depicts a back view, FIG. 1G depicts a left view, and FIG. 1H depicts a right view of fully assembled folding table 100, in accordance with an example.

Turning to FIG. 1A, it may be seen that example fully assembled folding table 100 includes four slats, four folding legs, and two alignment rods.

The slats are positioned to be oriented parallel to one another along their longitudinal axis, and include first outer slat 102A, adjacent to first inner slat 104A, adjacent to a second inner slat 104B, adjacent to a second outer slat 102B. Each of first outer slat 102A and the second outer slat 102B may be collectively referred to generally as an outer slat 102. Each of first inner slat 104A and second inner slat 104B may be collectively referred to generally as inner slat 104. Each slat of example fully assembled folding table 100 comprises a long board-like shape with six surfaces. The two surfaces that form the top and bottom of the tabletop have the largest surface areas, comprising a long rectangular shape with one dimension aligned with the longitudinal length of the slat and a width dimension extending along an end cap 122 of the slat. Two surfaces are at the ends of the long slats. The final two surfaces of each slat are the narrow, long surfaces that are adjacent to the other slats, which include apertures 116 to accommodate alignment rod 110.

In some examples, the slats may be hollow. In examples, the slats may be fabricated by extrusion, or by shaping sheet metal around a mandrel or other shaping tool. In some examples, the slats may be solid or semi-solid. In examples, the slats may be formed from metal such as titanium or aluminum, wood, resin, or any suitable material.

Outer slat 102 and inner slat 104 each include at least two apertures 116, one at each end along the longest dimension, which pass through the slat and allow alignment rod 110 to align the slats into a tabletop-like surface. Apertures 116 pass through the width of the slats perpendicular to the longitudinal and end cap directions.

Turning to FIG. 2A, it may be seen that outer slat 102 may further comprise two further apertures 134, which may be operable to couple a first leg section 106 to outer slat 102 via one or more fasteners, for example double-sided rivets 118.

In examples where a slat may be substantially solid, apertures 116 and two further apertures 134 may comprise boreholes. In further examples where the slats are substantially hollow, however, apertures 116 and 134 may comprise two sets of apertures aligned on opposite surfaces of the slat.

In examples, the slats may comprise the same or different dimensions. In the example folding table of the figures, inner slat 104 is slightly smaller than outer slat 102, which may allow each inner slat 104 to be stowed within the folded table legs of the table, as will be further described below.

Turning to FIG. 2D, it may be seen that outer slat 102 may include two of slot 150, one on each opposing longitudinal end. In some examples, slot 150 may be rectangular. In further examples, however, slot 150 may take other shapes. Each respective slot 150 may be sized and/or operable to allow a spring tab 144 to pass through it, engaging rod component 114 of alignment rod 110, as will be further described below.

While the folding table may be depicted in the figures with four slats, this is not intended to be limiting. In examples, fully assembled folding table 100 may comprise two or more slats.

As may best be seen in FIG. 1C, the four folding legs of example fully assembled folding table 100 each include a first leg section 106. First leg sections 106 are each pivotably connected to an outer slat 102 at a first longitudinal end 130 via a double-sided rivet 118. Example double-sided rivets 118 runs the width of first leg section 106 with endcaps positioned just outside apertures 134.

FIG. 2B best depicts perspective views of example first leg sections 106. First leg sections 106 and second leg section 108 each have a longitudinal length and a cross-section perpendicular to the longitudinal length. In FIG. 2B it may be seen that first leg section 106 may comprise a planar portion 124 and two side portions 126 bent inward towards each other at approximately 90 degrees so that the cross-sectional shape of first leg section 106 takes a modified "U" shape. In examples, planar portion 124 may be predominantly planar or substantially planar. Each of the two side portions 126 of first leg section 106 includes a respective aperture 128 at first longitudinal end 130 operable to be coupled to an outer slat 102 (for example, via double-sided rivets 118). Each of two side portions 126 further includes a second set of apertures 136 at a second longitudinal end 132 of first leg section 106 operable to couple first leg section 106 to second leg section 108 with a fastener, for example, via double-sided rivets 152.

First leg section 106 further comprises spring tab 144 extending from first longitudinal end 130 of planar portion 124. Spring tab 144 may be operable to keep the folding legs of the table open and secure when fully assembled, and to secure the pieces of the folding table together when it is in its folded or stowed configuration. Spring tab 144 extends or protrudes beyond first longitudinal end 130 of planar portion 124. In examples, spring tab 144 may comprise a predominantly rectangular shape or any other shape. In examples, spring tab 144 may have a similar thickness and composition to that of planar portion 124. In examples, the form of spring tab 144 may be further differentiated from the material composing planar portion 124 by two cuts 146, each respective cut positioned on an opposite side of spring tab 144, so that spring tab 144 is only coupled to planar portion 124 along a single edge. Two cuts 146 may increase the compliance of spring tab 144.

Spring tab 144 may further comprise a groove 148 in a portion extending beyond planar portion 124. Groove 148 may be straight or substantially straight, oriented perpendicular to a longitudinal length of first leg section 106. Groove 148 is oriented to be parallel to rod component 114 of alignment rod 110 when the folding table is fully assembled, as will be further described below.

FIG. 2B further depicts second leg section 108 in accordance with an example. Much like first leg section 106, second leg section 108 also comprises a predominately planar portion 142, and two side portions that are bent inwards towards each other at 90° so that the cross-sectional shape of second leg section 108 takes a modified "U" shape. Each of the two side portions 140 of second leg section 108 includes a respective aperture 138 at an end of second leg section 108 that couples to second longitudinal end 132 of first leg section 106. In the example of the figures, second leg section 108 couples to second longitudinal end 132 of first leg section 106 via two double-sided rivets 152, thereby leaving the space between respective aperture 138 open so that an inner slat 104 may be stored therein when the legs are folded.

While outer slat 102, leg section 106, and leg section 108 are depicted in the figures as being coupled via double-sided rivets 118 and double-sided rivet 152, this is not intended to be limiting. In examples, the legs and slats of the folding table may be coupled by any method.

In examples, first leg section 106 may be formed from a piece of sheet metal. The sheet metal may be stamped or machined to include apertures 128, 136, and spring tab 144, and then bent to include two side portions 126 and spring tab 144. Similarly, second leg section 108 may be formed from a piece of sheet metal stamped or machined to include two of aperture 138, and then bent to include two side portions 140.

Fully assembled folding table 100 may further comprise two of alignment rod 110. Alignment rod 110 may be used to align first outer slat 102A, first inner slat 104A, second inner slat 104B, and second outer slat 102B with one another, as depicted in the figures, thereby creating a flat table surface. In examples, flat may mean substantially flat.

Alignment rod 110 may comprise a stopper 112 and a rod component 114. Rod component 114 may be inserted through apertures 116 found on the sides of first outer slat 102A, first inner slat 104A, second inner slat 104B, and second outer slat 102B and used to align all the slats into a straight tabletop. Stopper 112 may be configured to be bigger than apertures 116 to prevent alignment rod 110 from being pushed beyond outer slat 102 during assembly. Stopper 112 may also provide a graspable shape/surface that a user may engage to assemble or disassemble the folding table. The example folding table depicted in the figures comprises two of alignment rod 110. This is not intended to be limiting, however. In examples, the folding table may comprise more than two alignment rods.

First outer slat 102A, first inner slat 104A, second inner slat 104B, and second outer slat 102B may further comprise end caps 122. As may be best seen in FIG. 2A, end caps 122 may comprise members that may be press-fit into the ends of the slats, or otherwise coupled to the ends of the slats using any known methods. End caps 122 may be operable to prevent the ends of outer slat 102 and/or inner slat 104 from damaging or scratching other objects. In examples, end caps 122 may be fabricated from plastic or any other known material.

Figure 1I:
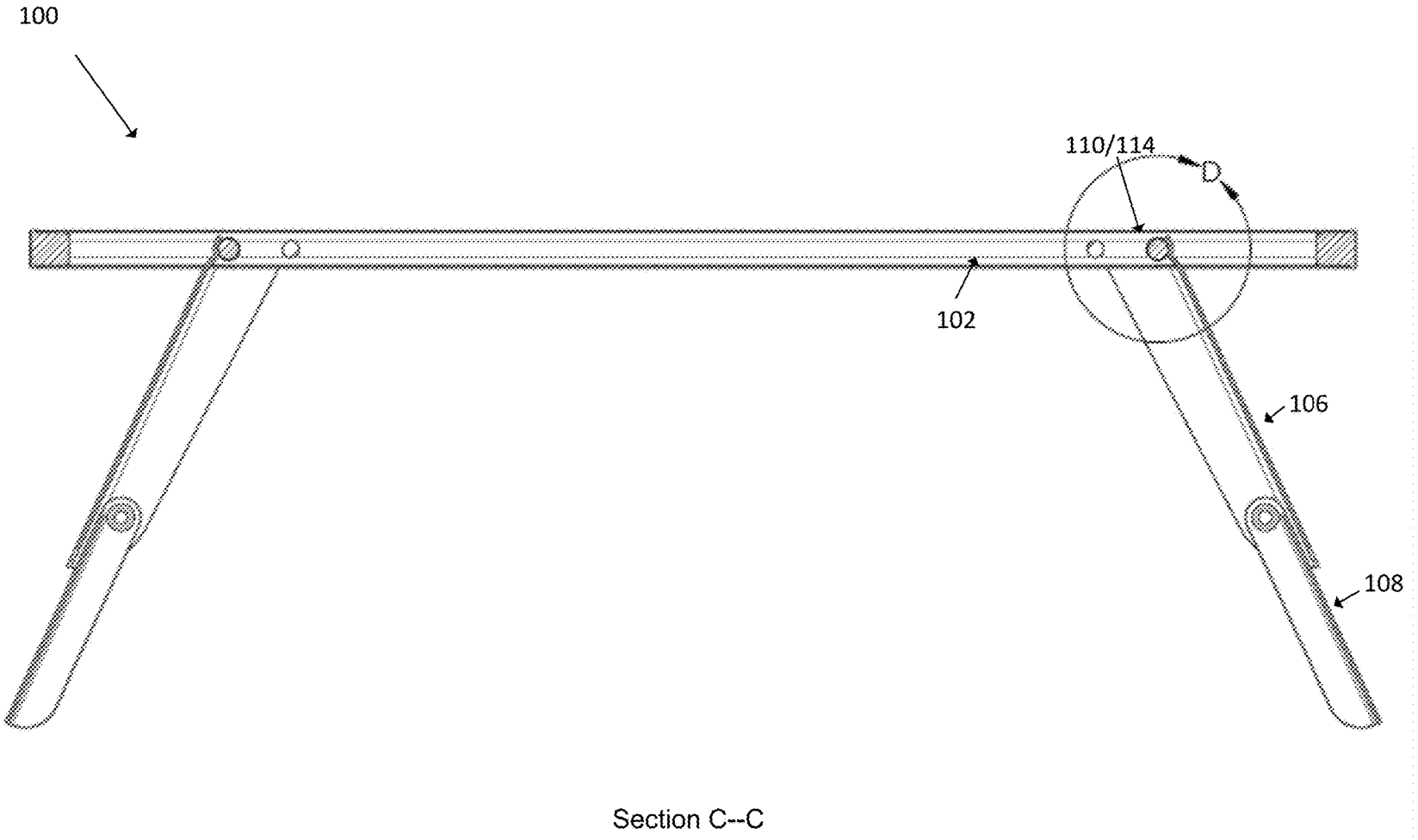
FIG. 1I depicts a section view of a fully assembled folding table according to section C-C, as noted in FIG. 1G.
Figure 1J:
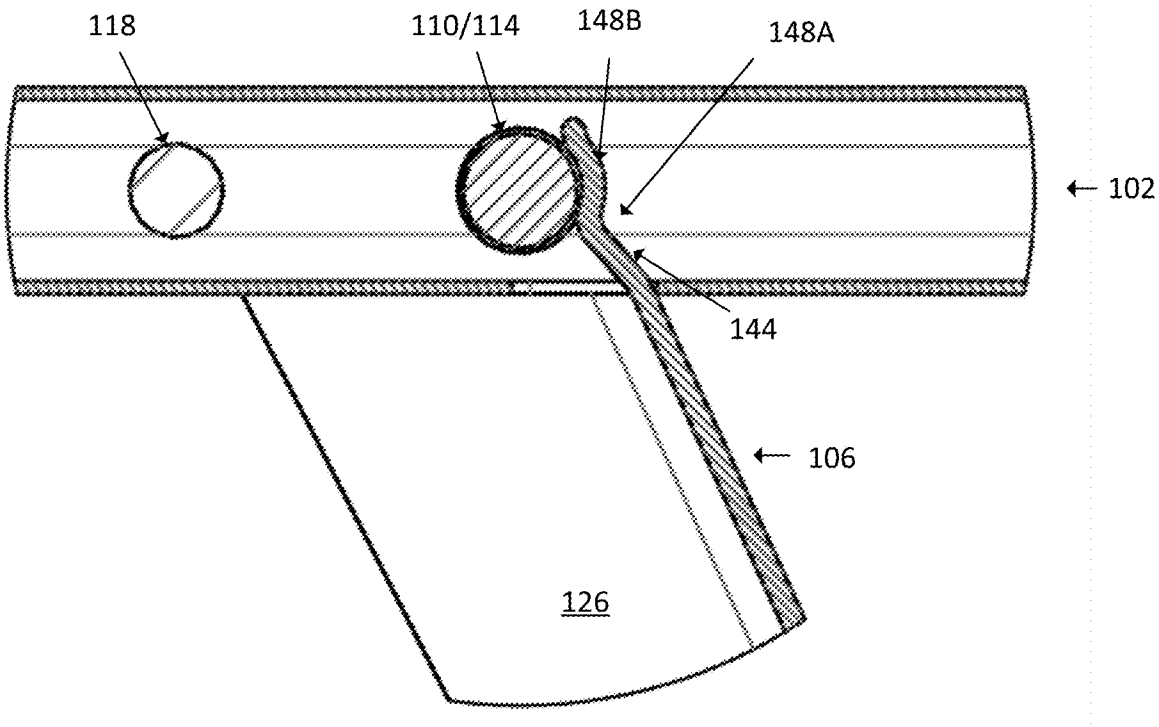
FIG. 1J depicts a detailed view of a fully assembled folding table according to section B, as noted in FIG. 1I.

FIG. 1I depicts a cross-sectional view of a fully assembled folding table according to section C-C, as noted in FIG. 1G. FIG. 1J depicts a detailed view D (as noted in FIG. 1I) of fully assembled folding table 100. In FIGS. 11 and 1J, it may be seen that when the table is fully assembled, second leg section 108 is fully extended so that it is substantially in line with first leg section 106. Alignment rod 110 is inserted into apertures 116 of first outer slat 102A, first inner slat 104A, second inner slat 104B, and second outer slat 102B. The example fully assembled table's folding legs flare away from one another along the longitudinal axis of the slats, at an obtuse angle with respect to the center of the slat. In examples, the angle of the slats to the fully extended legs may be approximately 45 degrees, or between 40-50 degrees. In examples, the folding table legs may be designed to extend at any angle with respect to outer slat 102.

After second leg section 108 is extended and alignment rod 110 is inserted into slat 102 and slat 104, first leg section 106 may be moved to its fully open position. In FIG. 2D, a pass-through view is provided of where alignment rod 110 may be positioned within outer slat 102 when inserted into apertures 116. In the example provided in the figures, it can be seen that rod component 114 may be positioned at each slot 150 to be offset slightly towards the center of outer slat 102. FIG. 1J depicts this as well. In FIG. 1E, which depicts the fully assembled configuration, it may be seen that when first leg section 106 is fully extended, spring tab 144 may insert into slot 150, thereby encountering rod component 114 (denoted by the dotted lines) positioned inside outer slat 102. When planar portion 124 comes to rest against an opening of slot 150, outer slat 102 is fully extended in its assembled position.

Returning to FIG. 1J, it may be seen that the groove 148 of spring tab 144 may comprise a V-shaped recess 148A or depression, with one side of the "V" comprising a rounded tail 148B. When the folding table is fully assembled, rounded tail 148B of V-shaped recess 148A may be shaped with a curve to provide the best contact between a circumferential exterior of rod component 114 and spring tab 144, so that spring tab 144 becomes fully coupled or seated against rod component 114. In this way, spring tab 144 may help maintain the folding legs of fully assembled folding table 100 in a secure assembled position via a friction fit. V-shaped recess 148A may help transition spring tab 144 between rounded tail 148B and planar portion 124.

Spring tab 144 extends beyond planar portion 124 of first leg section 106, thereby allowing spring tab 144 to have more spring or compliance than first leg section 106. Some examples of spring tab 144 may include two cuts 146, which may further define spring tab 144 from planar portion 124 and may add to the springiness or compliance of spring tab 144. When first leg section 106 is fully extended and spring tab 144 comes into contact with rod component 114, spring tab 144 bends slightly, allowing groove 148 to slide around the exterior rounded surface of rod component 114. The compliant nature of spring tab 144 increases the pressure between groove 148 and rod component 114 when first leg section 106 is fully extended. This may increase the friction force between alignment rod 110 and spring tab 144, further securing first leg section 106 in an open position in a kind of press friction fit.

In examples, spring tab 144 and/or alignment rod 110 may have a textured surface or may be fabricated from a material to increase or decrease the friction between these components. In examples, the length or dimensions of spring tab 144 and/or groove 148 may be adjusted to increase or decrease the compliance of spring tab 144, and therefore the pressure between spring tab 144 and alignment rod 110 when the table is fully assembled. In this way, spring tab 144 and/or alignment rod 110 may be designed to provide a folding table that is secure and stable when fully assembled, and also easy for user to assemble, disassemble, and stow without excessive force.

Figure 3A:
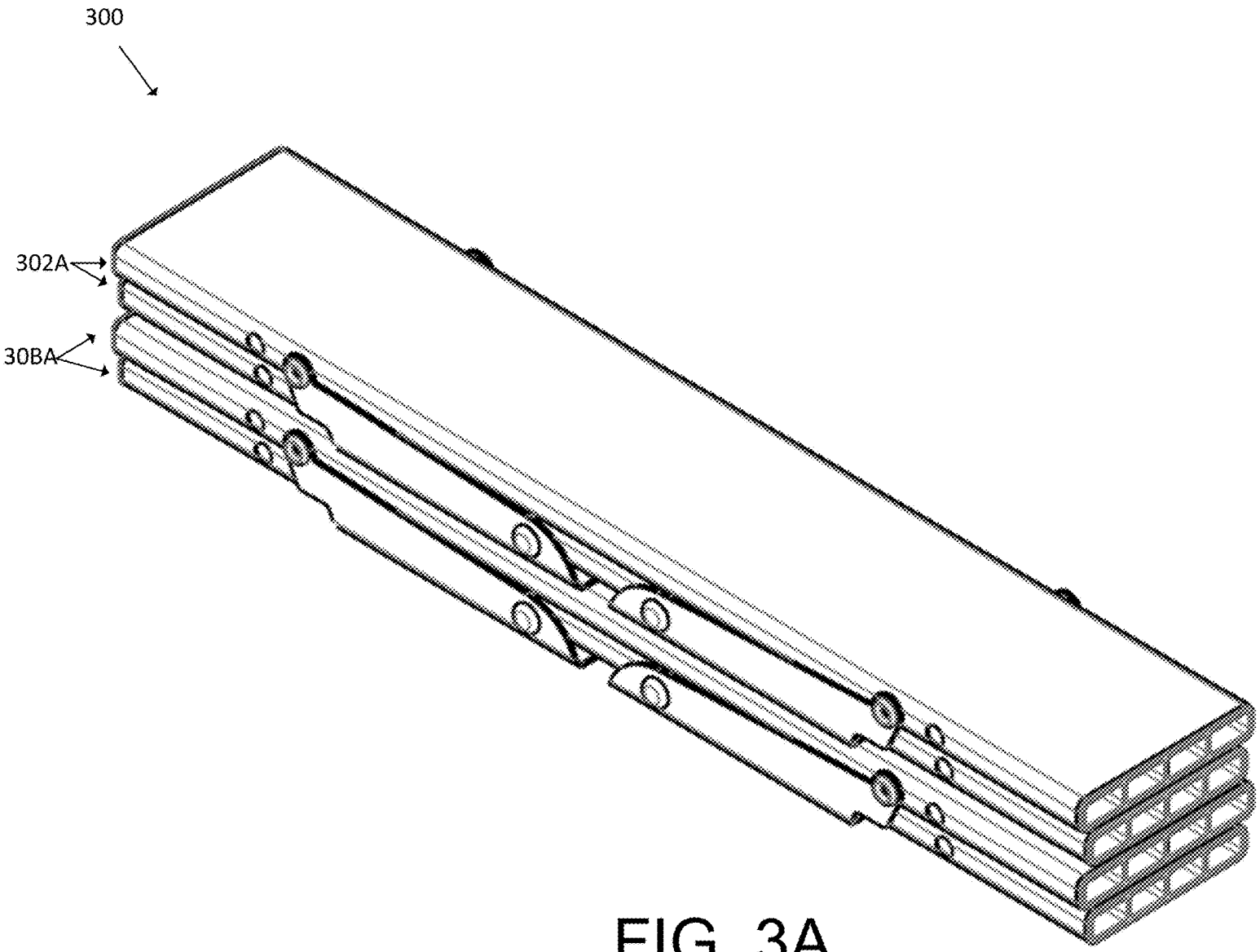
FIG. 3A depicts a perspective view including a top side of a stowed folding table, in accordance with an example.
Figure 3B:
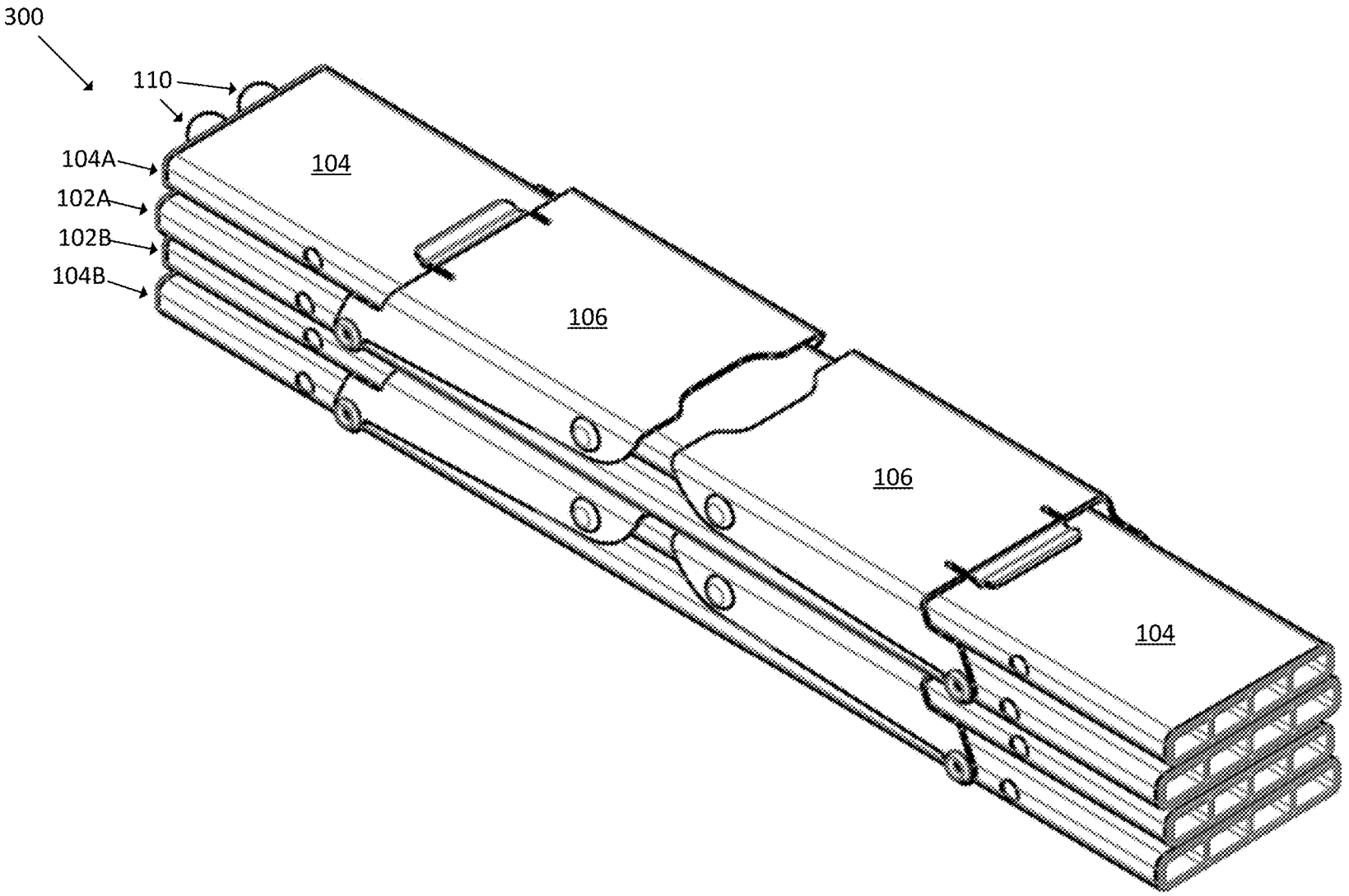
FIG. 3B depicts a perspective view including a bottom side of a stowed folding table, in accordance with an example.
Figure 3C:
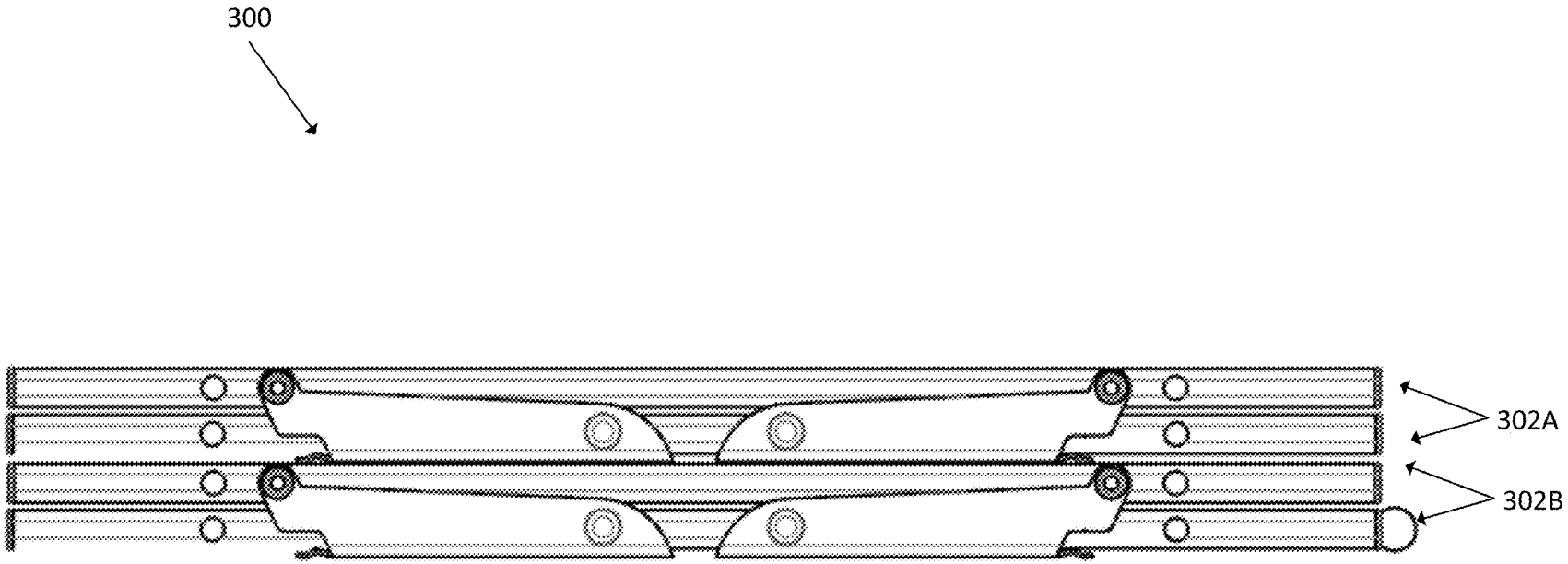
FIG. 3C depicts a front view of a stowed folding table, in accordance with an example.
Figure 3D:
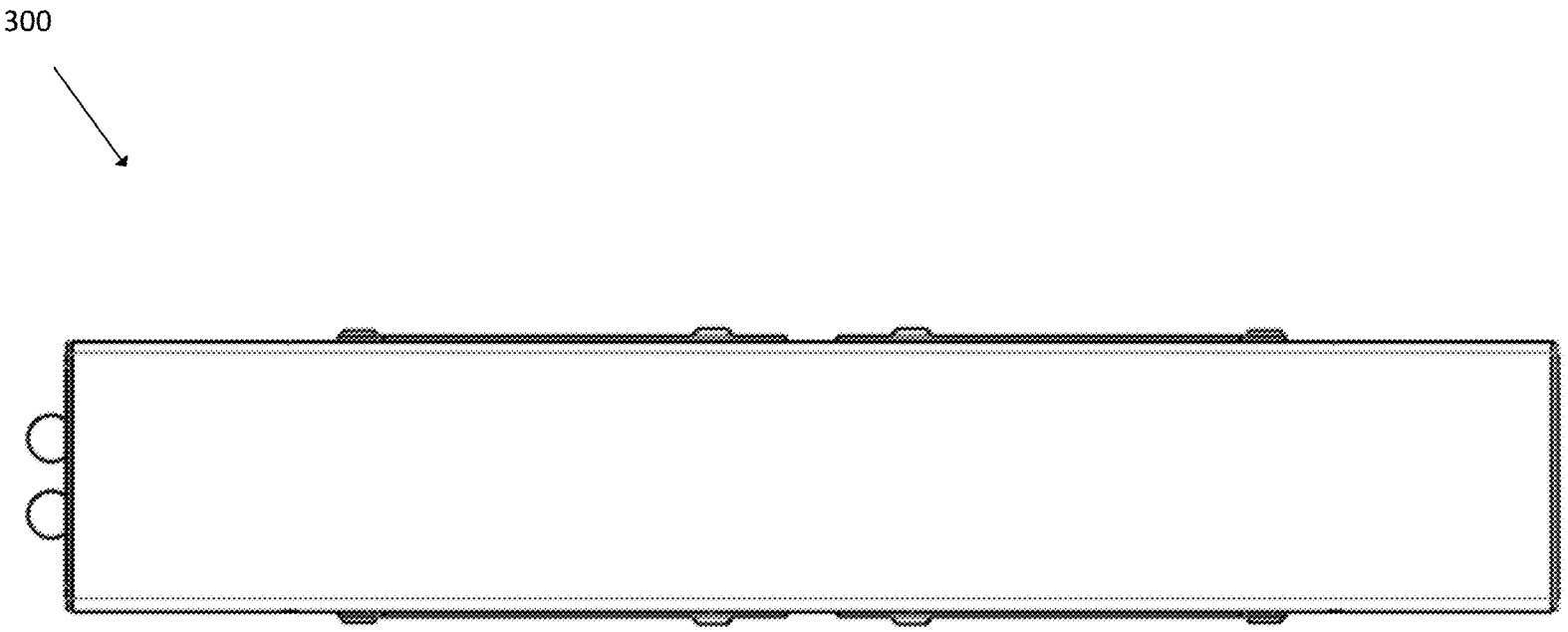
FIG. 3D depicts a top view of a stowed folding table, in accordance with an example.
Figure 3E:
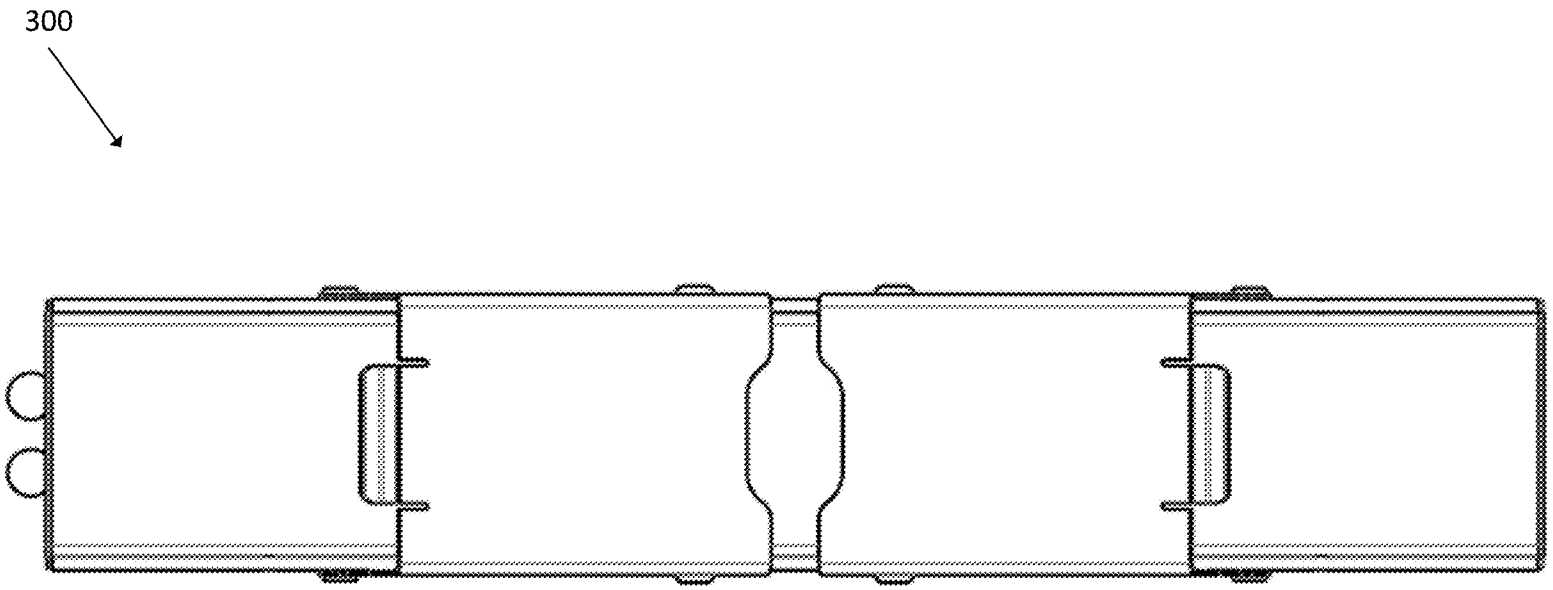
FIG. 3E depicts a bottom view of a stowed folding table, in accordance with an example.
Figure 3F:
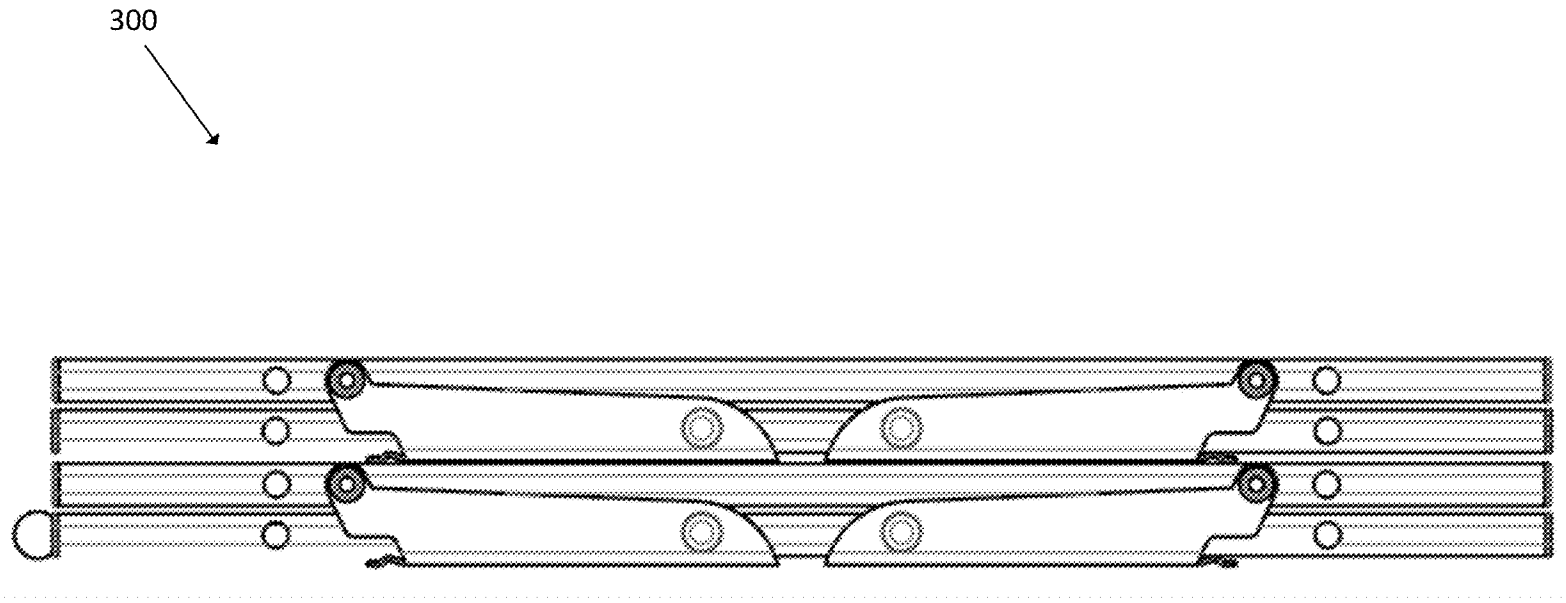
FIG. 3F depicts a back view of a stowed folding table, in accordance with an example.
Figure 3H:
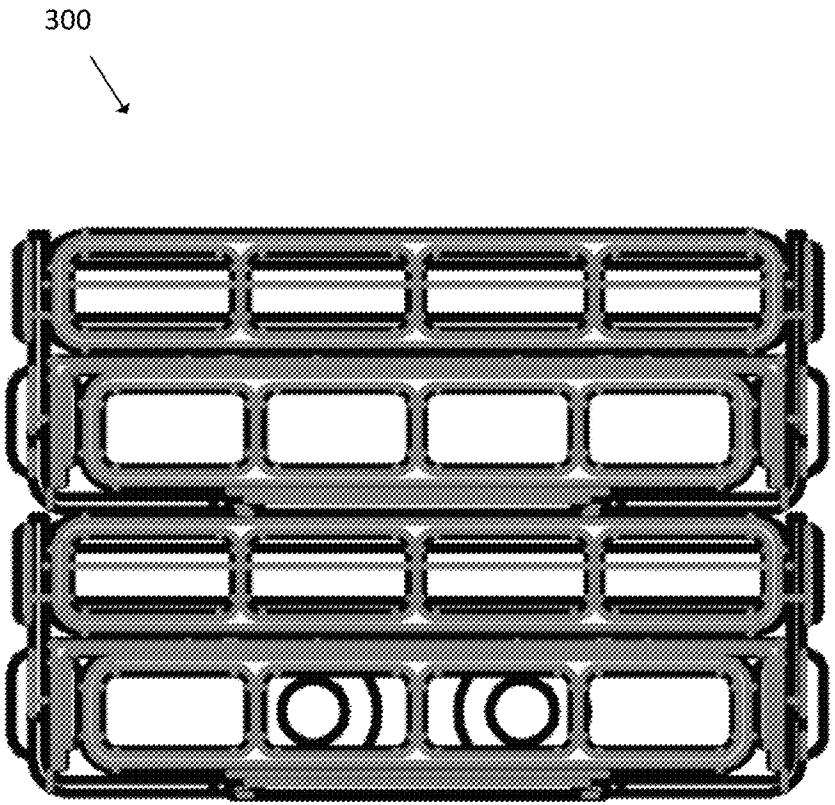
FIG. 3H depicts a right view of a stowed folding table, in accordance with an example.
Figure 3G:
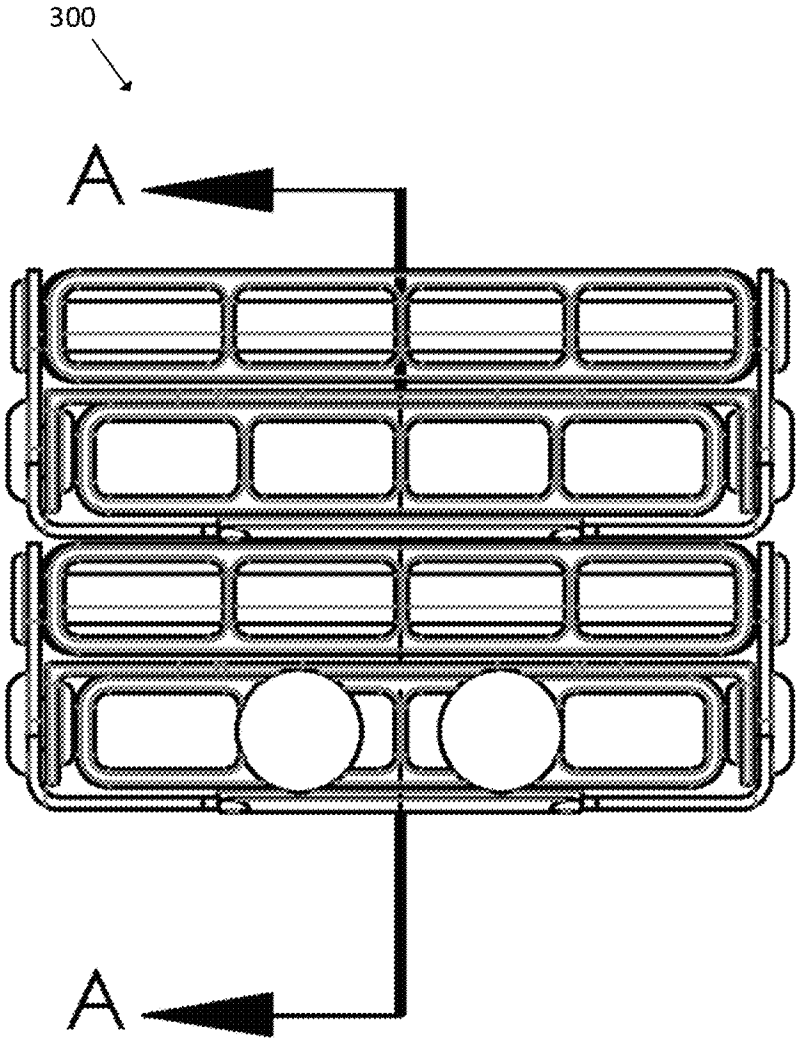
FIG. 3G depicts a left view of a stowed folding table, in accordance with an example.
Figure 3I:
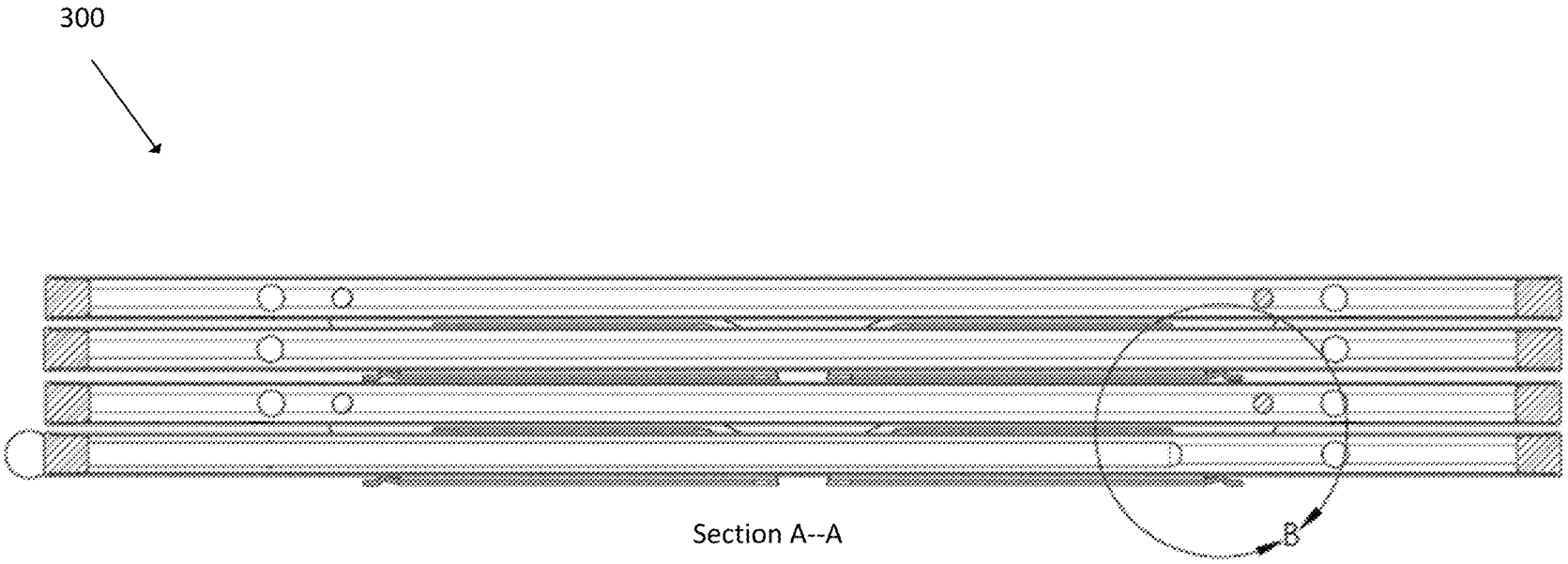
FIG. 3I depicts a section view of a stowed folding table according to section A-A, as noted in FIG. 3G.
Figure 3J:
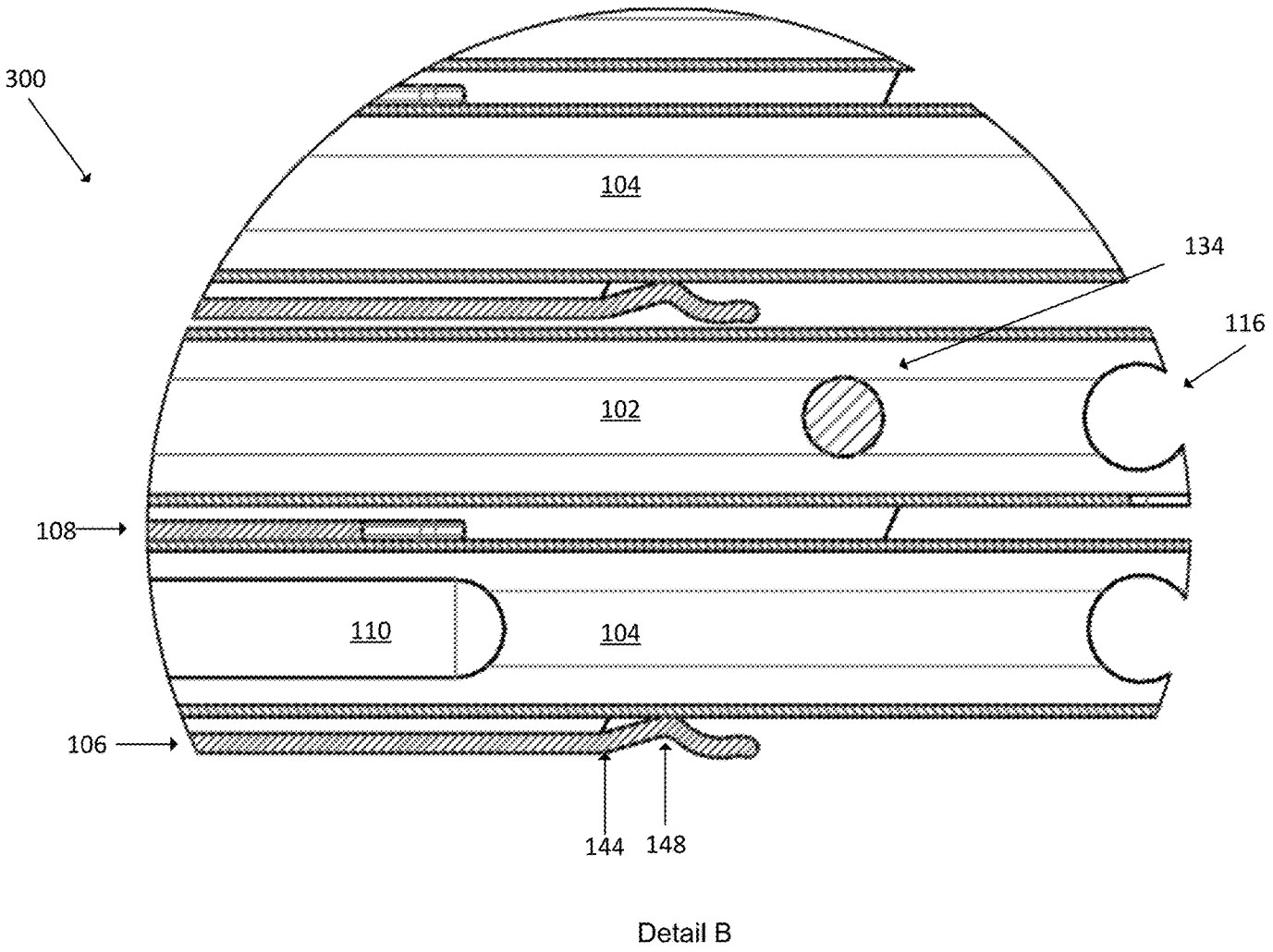
FIG. 3J depicts a detailed view of a stowed folding table according to section B, as noted in FIG. 3I.

FIG. 3A depicts a perspective view including the top of and FIG. 3B depicts a perspective view including bottom of fully disassembled and stowed folding table 300, according to an example. FIG. 3C depicts a front view, FIG. 3D depicts a top view, FIG. 3E depicts a bottom view, FIG. 3F depicts a back view, FIG. 3G depicts a left view, and FIG. 3H depicts a right view of fully disassembled and stowed folding table 300, in accordance with an example. FIG. 3I depicts a cross-sectional view of a fully assembled folding table according to section A-A, as noted in FIG. 3G. FIG. 3J depicts a detailed view B (as noted in FIG. 3I) of fully disassembled and stowed folding table 300.

As may be seen in FIG. 3A, the folding table may be disassembled so that slat 102 and slat 104 are placed into a compact stack for transport or storage. Firstly, first leg section 106 may be moved towards the center of the table, thereby countering the friction force between spring tab 144 and alignment rod 110. Once spring tab 144 is disengaged from alignment rod 110, the alignment rod 110 may be removed from the assembled table 100.

As may best be seen in FIG. 2C, to disassemble, fold, and/or stow the table, the user may fold each leg. First, second leg section 108 may be pivoted along double-sided rivets 152 so that two side portions 140 of second leg section 108 tuck inside two side portions 126 of first leg section 106. Next, first leg section 106 is pivoted completely on double-sided rivets 118 so that predominately planar portion 142 of second leg section 108 comes to rest against a bottom surface of outer slat 102. First leg section 106 and second leg section 108 form a pocket together, with planar portion 124 of first leg section 106 being separated from predominately planar portion 142 of second leg section 108 by a gap that may be designed to be just large enough to store inner slat 104, which may be slightly smaller than outer slat 102 to fit inside the pocket.

In FIG. 3J, it may be seen that groove 148 of spring tab 144 is positioned to point down towards first leg section 106 when the table legs are completely folded. Groove 148 may apply pressure to a surface of inner slat 104 once positioned inside of the folding leg, thereby securely retaining inner slat 104 to outer slat 102. The bend of groove 148 may extend inward from the plane of planar portion 124 towards inner slat 104, so spring tab 144 may be slightly flexed when inner slat 104 is inserted within the folded leg. This may increase the friction force between spring tab 144 and inner slat 104, further retaining inner slat 104 therein.

In examples, spring tab 144 and inner slat 104 may be fabricated from materials designed to increase or decrease the friction force between the members when they are disassembled, folded, and stowed together, thereby allowing for a secure coupling between the members that a user can engage and disengaged without excess force.

In this way, spring tab 144 may function to both secure the table legs open in the fully assembled table position, and to secure one inner slat 104 to each outer slat 102 when the table is disassembled and stowed.

In FIG. 3I, it may be further seen that one or more of alignment rod 110 may be stored inside a slat along the longitudinal length of the slat. For example, alignment rod 110 may be stored in inner slat 104. In examples, alignment rod 110 may be inserted into openings in end caps 122. In examples, end caps 122 may include apertures shaped to retain alignment rod 110 to prevent alignment rod 110 from shaking around inside inner slat 104 when transported.

Returning to FIG. 3A, it may be seen that table assembly 302A and table assembly 302B, each comprising one outer slat 102 with folded legs and one inner slat 104 stored within the folded legs, may be stacked upon one another for easy, compact storage. In examples, the two respective table assembly 302A and table assembly 302B pictured stacked in FIGS. 3A-3J may be carried separately or coupled together via any method. For example, the two table assemblies 302A and 302B may be stored in a stuff sack, strapped together, or coupled together via any method.

Figure 4:
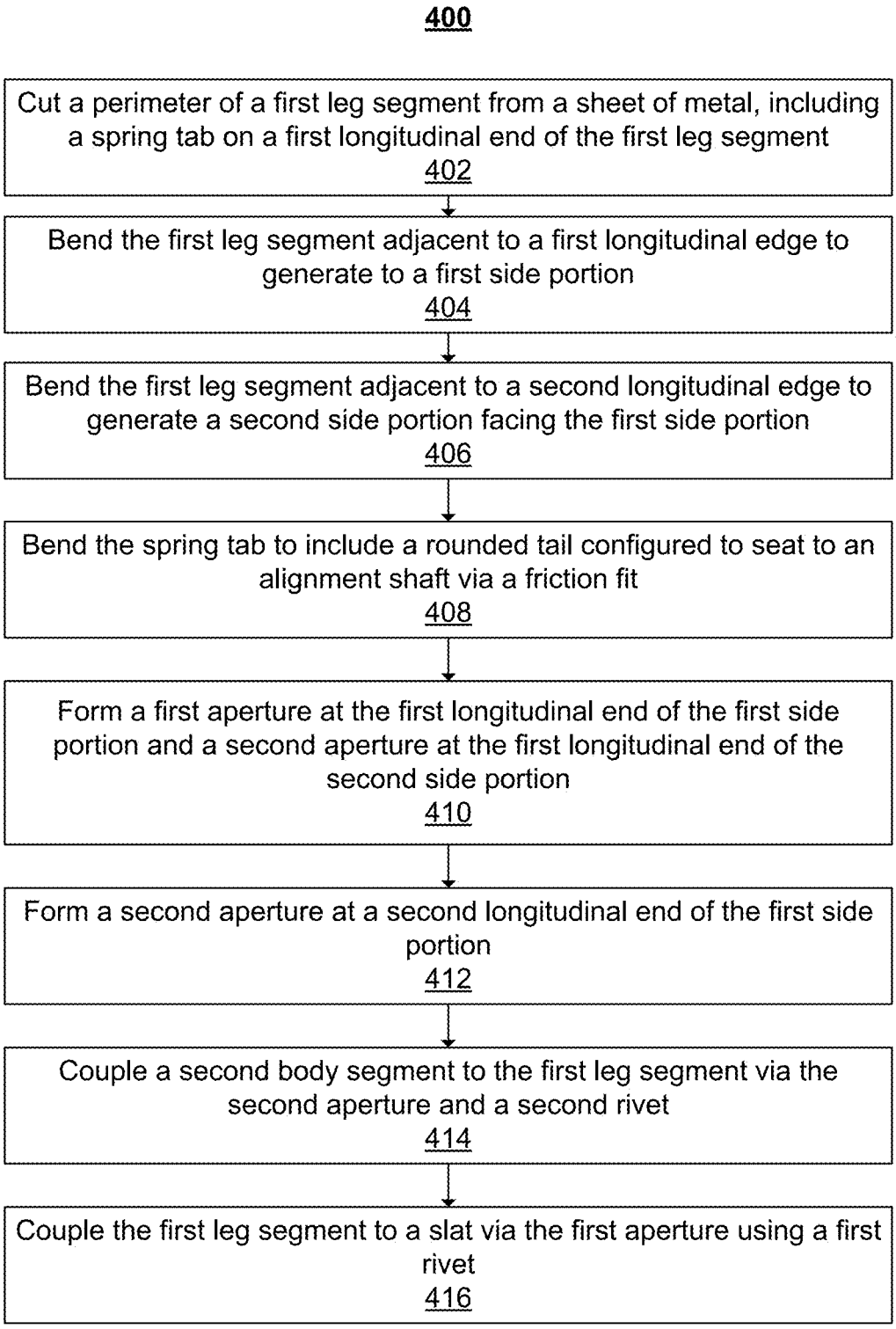
FIG. 4 depicts a method in accordance with examples.

FIG. 4 depicts a method 400 in accordance with examples. Method 400 may be used to manufacture a portion, or all of the table described herein.

Method 400 may begin with step 402. In step 402, a perimeter of a first leg segment may be cut from a sheet of metal, including a spring tab on a first longitudinal end of the leg segment, as discussed above. For example, a perimeter of first leg section 106 may be cut from a sheet of aluminum.

Method 400 may continue with steps 404 and 406. In step 404, the leg segment may be bent adjacent to a first longitudinal edge to produce a first side portion. In step 406, the leg segment may be bent adjacent to a second longitudinal edge to produce a second side portion facing the first side portion. For example, first leg section 106 may be formed by bending two side portions 126 on opposing sides of planar portion 124, as discussed above.

Method 400 may continue with step 408. In step 408, the spring tab may be bent to include a rounded tail configured to be coupled to an alignment shaft via a friction fit. For example, spring tab 144 may be bent to include rounded tail 148B, as discussed above.

Method 400 may continue with step 410. In step 410, a first aperture may be formed at the first longitudinal end of the first side portion and a second aperture at the first longitudinal end of the second side portion. For example, aperture 128 may be formed on first longitudinal end 130 on one of the two side portions 126, as described above.

Method 400 may continue with step 412. In step 412, a second aperture may be formed at a second longitudinal end of the first side portion. For example, one of apertures 136 may be formed on one of two side portions 126 at second longitudinal end 132, as discussed above.

Method 400 may continue with step 414. In step 414, a second leg segment may be coupled to the first leg segment via the second aperture and a second rivet. For example, second leg section 108 may be coupled to first leg section 106 via double-sided rivets 152, as described above.

Method 400 may continue with step 416. In step 416, the first leg segment may be coupled to a slat via the first aperture using a first rivet. For example, first leg section 106 may be coupled to first outer slat 102A via aperture 128 and one of double-sided rivets 118, as described above.

In some aspects, the techniques described herein relate to a table, wherein the slat further includes a borehole perpendicular to a normal of the planar surface and a longitudinal direction of the slat, the borehole configured to seat the alignment shaft within the slat, and a coupling aperture on the planar surface positioned to allow the spring tab to pass through the planar surface to be seated on the alignment shaft.

In some aspects, the techniques described herein relate to a table, wherein the planar portion of the leg segment is coupled along a first longitudinal edge to a first side portion and along a second longitudinal edge to a second side portion, the first side portion facing the second side portion, and wherein the first leg is pivotably coupled to the slat at the first longitudinal end of the first side portion and the first longitudinal end of the second side portion.

In some aspects, the techniques described herein relate to a table, wherein the first leg is pivotably connected to the slat with a fastener that passes through a first aperture at the first longitudinal end of the first side portion.

In some aspects, the techniques described herein relate to a table, wherein the spring tab includes a rounded tail configured to seat to the alignment shaft via the friction fit.

In some aspects, the techniques described herein relate to a table, wherein the spring tab further includes a V-shaped recess between the rounded tail and the planar portion.

In some aspects, the techniques described herein relate to a table, wherein the slat is a first slat, and the table further includes: a second slat coupled to the first slat via the alignment shaft; a third leg pivotably coupled to the second slat; and a fourth leg pivotably coupled to the second slat.

In some aspects, the techniques described herein relate to a table, wherein the leg segment is a first leg segment and the first leg further includes: a second leg segment pivotably coupled to the first leg segment at a second longitudinal end of the first leg segment.

In some aspects, the techniques described herein relate to a table, wherein the spring tab applies pressure on a second slat stowed within a cavity formed the first leg segment and the second leg segment when configured in a folded position.

In some aspects, the techniques described herein relate to a table, wherein the first leg is positioned at an angle of approximately 45 degrees when extended with respect to the planar surface of the slat.

In some aspects, the techniques described herein relate to a leg, wherein spring tab includes a rounded tail configured to be coupled to an alignment shaft via a friction fit.

In some aspects, the techniques described herein relate to a leg, wherein the spring tab further includes a V-shaped recess between the rounded tail and the planar portion.

In some aspects, the techniques described herein relate to a leg, wherein the first side portion includes a first aperture at the first longitudinal end and the second side portion includes a second aperture at the first longitudinal end.

In some aspects, the techniques described herein relate to a leg, wherein the leg segment is a first leg segment and the leg further includes: a second leg segment pivotably coupled to the first leg segment at a second longitudinal end of the first leg segment.

In some aspects, the techniques described herein relate to a leg, wherein the planar portion is a first planar portion and the second leg segment includes a second planar portion coupled along a third longitudinal edge to a third side portion and along a fourth longitudinal edge to a fourth side portion, the third side portion facing the fourth side portion.

In some aspects, the techniques described herein relate to a method, further including: forming a first aperture at the first longitudinal end of the first side portion and a second aperture at the first longitudinal end of the second side portion; and coupling the first leg segment to a slat via the first aperture using a first rivet.

In some aspects, the techniques described herein relate to a method, further including: forming a second aperture at a second longitudinal end of the first side portion; coupling a second leg segment to the first leg segment via the second aperture and a second rivet.

In the foregoing description, when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application, if any, may be amended to recite exemplary relationships described in the specification or shown in the figures.

As used in this specification, a singular form may, unless definitely indicating a particular case in terms of the context, include a plural form. Spatially relative terms (e.g., over, above, upper, under, beneath, below, lower, and so forth) are intended to encompass different orientations of the device in use or operation in addition to the orientation depicted in the figures. In some implementations, the relative terms above and below can, respectively, include vertically above and vertically below. In some implementations, the term adjacent can include laterally adjacent to or horizontally adjacent to.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A table comprising:

a slat defining a planar surface;

a first leg including:

a leg segment with a planar portion, and a spring tab at a first position at a first longitudinal end of the leg segment, the first leg being pivotably coupled at a second position at the first longitudinal end of the leg segment to the slat;

a second leg pivotably coupled to the slat; and an alignment shaft configured to be coupled to the slat, the spring tab being configured to be coupled to the alignment shaft via a friction fit as the first leg is rotated to an open position.

2. The table of claim 1, wherein the slat further includes a borehole perpendicular to a normal of the planar surface and a longitudinal direction of the slat, the borehole configured to seat the alignment shaft within the slat, and a coupling aperture on the planar surface positioned to allow the spring tab to pass through the planar surface to be seated on the alignment shaft.

3. The table of claim 1, wherein the planar portion of the leg segment is coupled along a first longitudinal edge to a first side portion and along a second longitudinal edge to a second side portion, the first side portion facing the second side portion, and the second position is on the first side portion.

4. The table of claim 3, wherein the first leg is pivotably connected to the slat with a fastener that passes through an aperture at the second position.

5. The table of claim 3, further comprising an inner slat storable in a space between the first side portion and the second side portion when the table is folded.

6. The table of claim 1, wherein the spring tab includes a rounded tail configured to seat to the alignment shaft via the friction fit.

7. The table of claim 6, wherein the spring tab further comprises a V-shaped recess between the rounded tail and the planar portion.

8. The table of claim 1, wherein the slat is a first slat, and the table further comprises:

a second slat coupled to the first slat via the alignment shaft;

a third leg pivotably coupled to the second slat; and a fourth leg pivotably coupled to the second slat.

9. The table of claim 1, wherein the leg segment is a first leg segment and the first leg further comprises:

a second leg segment pivotably coupled to the first leg segment at a second longitudinal end of the first leg segment.

10. The table of claim 9, wherein the slat is a first slat and the table further comprises:

a second slat, wherein the spring tab applies pressure on the second slat when the second leg segment is pivoted into the first leg segment and the second slat is inserted into a space between the first leg segment and the second leg segment.

11. The table of claim 9, wherein the planar portion is a first planar portion and the second leg segment comprises a second planar portion coupled along a third longitudinal edge of the second planar portion to a third side portion and along a fourth longitudinal edge of the second planar portion to a fourth side portion, the third side portion facing the fourth side portion.

12. The table of claim 9, wherein the second leg segment is configured to fit within the first leg segment when configured in a folded position.

13. The table of claim 1, wherein the first leg is positioned at an angle of approximately 45 degrees when extended with respect to the planar surface of the slat.

14. The table of claim 1, wherein the planar portion of the leg segment is coupled along a first longitudinal edge to a first side portion and along a second longitudinal edge to a second side portion, the first side portion facing the second side portion.

15. The table of claim 14, wherein the second position is on the first side portion and the first leg is also pivotably coupled to the slat at the first longitudinal end of the second side portion.

16. The table of claim 1, wherein the spring tab comprises a rounded tail oriented perpendicular to a longitudinal axis of the first leg and parallel to the alignment shaft.

17. The table of claim 1, wherein the spring tab extends beyond the first longitudinal end of the planar portion.

18. The table of claim 1, wherein the spring tab has a thickness similar to that of the planar portion.

19. The table of claim 1, wherein the leg segment is formed from a single piece of sheet metal with the spring tab defined by two parallel cuts in the first longitudinal end of the planar portion.

20. The table of claim 19, wherein the leg segment further includes a first side portion formed via a first bend along a first longitudinal edge of the planar portion and a second side portion formed via a second bend along a second longitudinal edge of the planar portion, the first side portion facing the second side portion.

* * * * *